US005153574A

United States Patent [19]

Kondo

[11] Patent Number: 5,153,574

[45] Date of Patent: Oct. 6, 1992

[54] INTERFACE FOR A THIN DISPLAY

[75] Inventor: Kenichi Kondo, Tokyo, Japan

[73] Assignee: Seiko Instruments Inc., Japan

[21] Appl. No.: 463,932

[22] Filed: Jan. 8, 1990

Related U.S. Application Data

[63] Continuation of Ser. No. 16,067, Feb. 18, 1987, abandoned.

[30] Foreign Application Priority Data

Mar. 3, 1986 [JP] Japan ..... 61-45880
Jun. 27, 1986 [JP] Japan ..... 61-150922

[51] Int. Cl.[5] ..... G09G 3/36; G09G 1/02

[52] U.S. Cl. ..... 340/784; 340/799; 358/241

[58] Field of Search ..... 340/784, 703, 799, 750, 340/748, 781, 782; 358/241

[56] References Cited

U.S. PATENT DOCUMENTS 4,210,934 7/1980 Kuturagi ..... 358/241
4,342,029 7/1982 Hofmanis et al. ..... 340/703
4,581,655 4/1986 Ide et al. ..... 358/241
4,591,902 5/1986 Masubuchi ..... 358/241
4,642,628 2/1987 Murata ..... 340/703

FOREIGN PATENT DOCUMENTS 3606404 2/1986 Fed. Rep. of Germany ..... 340/784
2176042 12/1986 United Kingdom ..... 340/703

OTHER PUBLICATIONS

Artwick, "Microcomputer Displays, Graphics, and Animation", Prentice-Hall, N.J., 1985, pp. 64–67 and 73–76.

*Primary Examiner*—Ulysses Weldon
*Assistant Examiner*—M. Fatahi Yar
*Attorney, Agent, or Firm*—Bruce L. Adams; Van C. Wilks

[57] ABSTRACT

An interface for a thin display panel having timing circuit for taking a timing so as to introduce effective color display data into RAMs according to synchronizing signal, RAMs for storing said effective color display data, color data treating circuit for generating desired mixed color data using the stored color display data and timing signal generator for generating timing signals necessary for operating a driver of a thin color display panel.

8 Claims, 18 Drawing Sheets

INTERFACE FOR A THIN DISPLAY

This is a Rule 62 continuation application of parent application Ser. No. 016,067 filed Feb. 18, 1987 now abandoned.

BACKGROUND OF THE INVENTION

The present invention relates to an interface circuit for a thin display, e.g., a liquid crystal display, EL display, a plasma display or a LED display. More particularly, the present invention relates to a color display device having an interface circuit which can be used as a compact and lightweight display device by utilizing the interface signals of CRT displays that have gained a wide application particularly in personal computers.

The present invention relates to an interface circuit which can play the role of a color display interface in the same driving circuit construction as those of the prior art devices by utilizing interface signals of a CRT display, storing independent color display data in independent RAMs and converting the display data into mixed display data of red, green and blue at the time of read-out.

Liquid crystal display devices have the characterizing features in that they are thin, operate at a low voltage and consume less power. Therefore, they have been put into practical application recently to terminal display devices of personal computers, word processors, and the like, by use of a large dot matrix panel. Nowadays LSI circuits that can be connected directly to CRT interfaces as portable computers have been developed and manufacturers of various office automation equipment have produced interface circuits that are used exclusively for liquid crystal display devices, by means of gate arrays. For these reasons, there exist vigorous demands for the liquid crystal display devices. Although these liquid crystal display devices have a display capacity of such as 640×200 dots that can replace CRT, they are generally monochoric display and are not sufficient in terms of display information quantity when used for graphic illustration. In addition, they are not sufficiently attractive because they merely display ON-OFF by utilizing one or two of red, green and blue displays for a display panel of the simple matrix.

SUMMARY OF THE INVENTION

It is therefore an object of the invention to provide an improved interface for a thin display panel. Another object of the invention is to provide an interface circuit that can make a multi color display and can be applied to flat display devices by utilizing interface signals of color CRTs.

FIR. 5 is a timing chart of interface signals to the LC panel driver.

Figure 6:
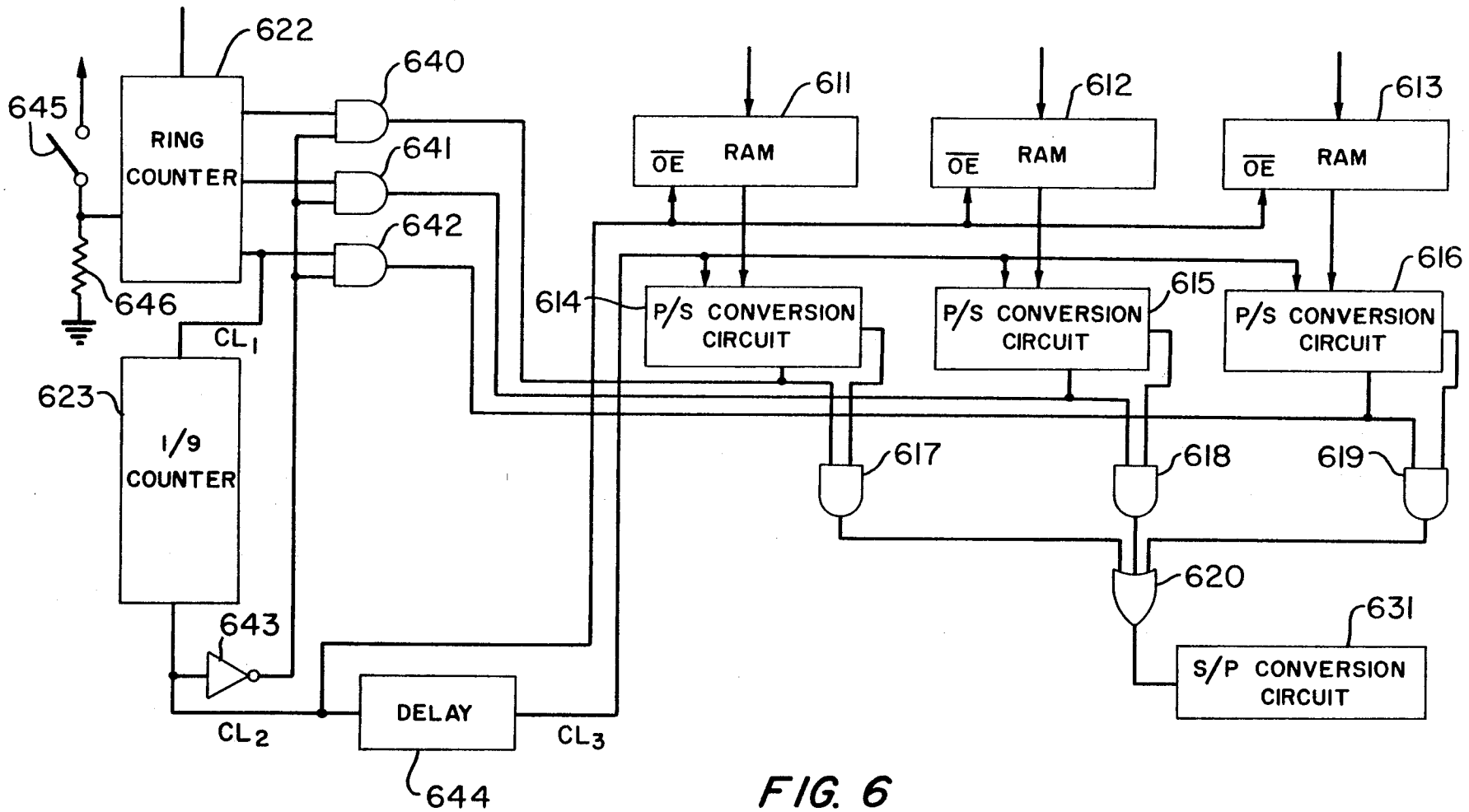
Figure 7A:
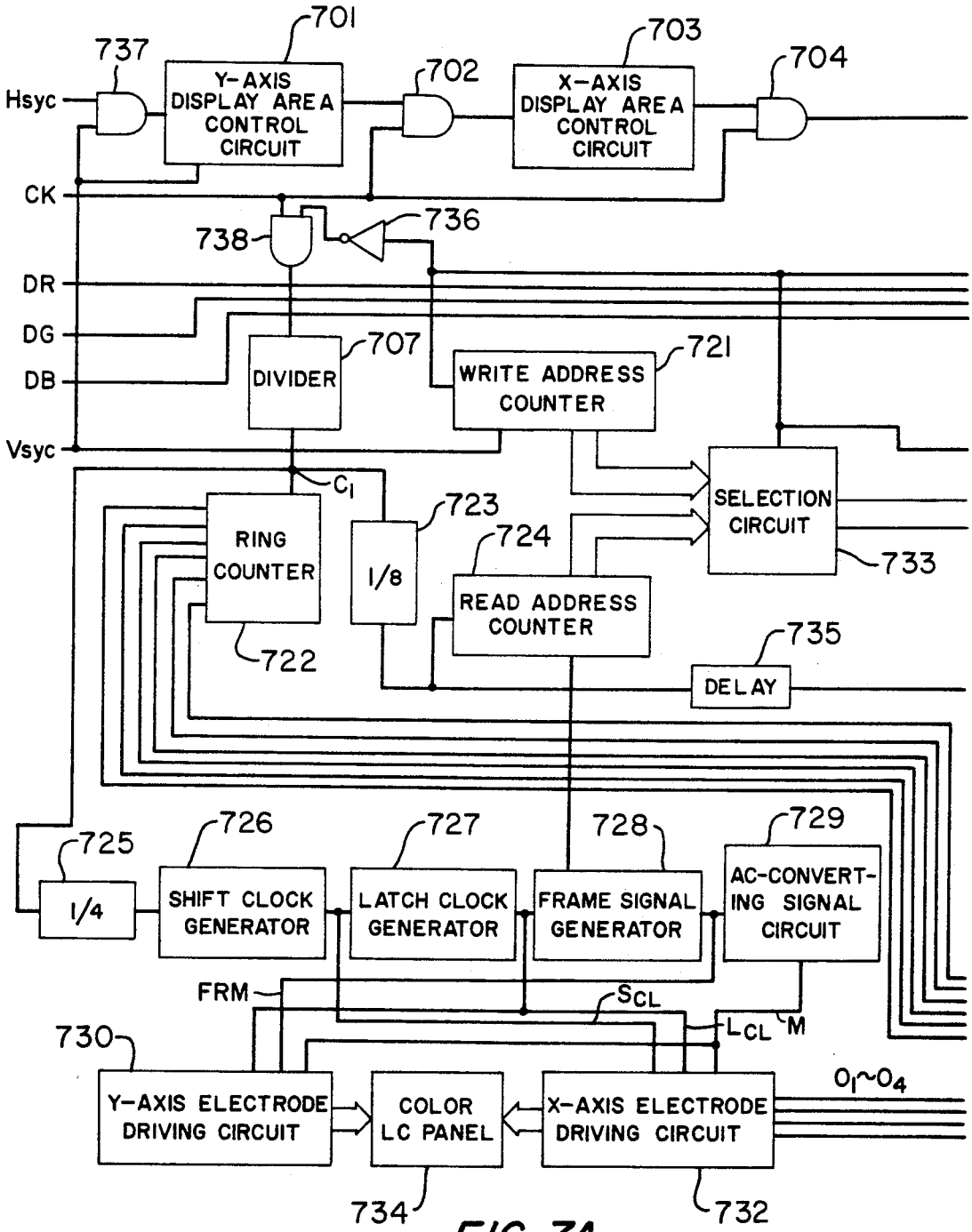
Figure 7B:
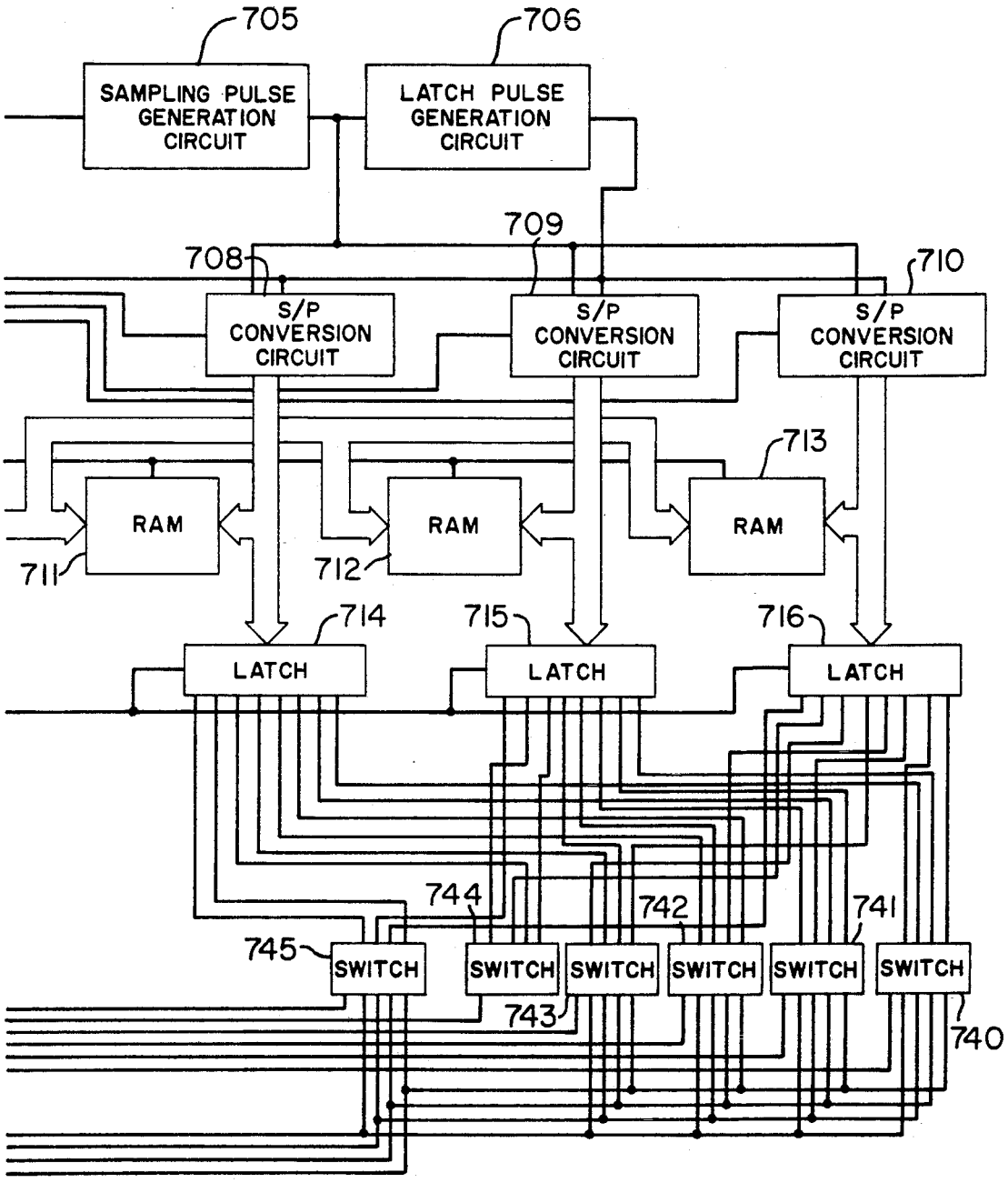
Figure 8A:
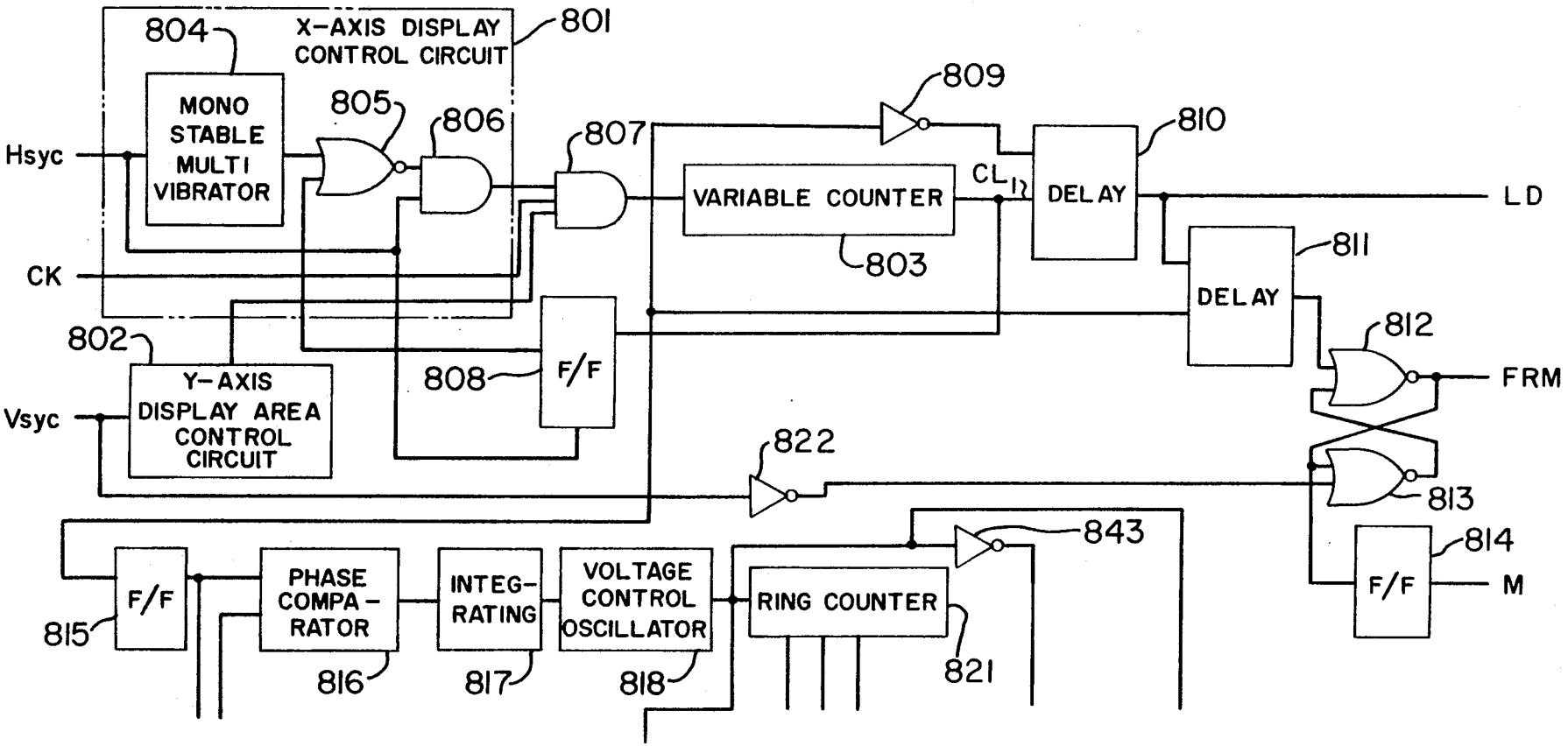
Figure 8B:
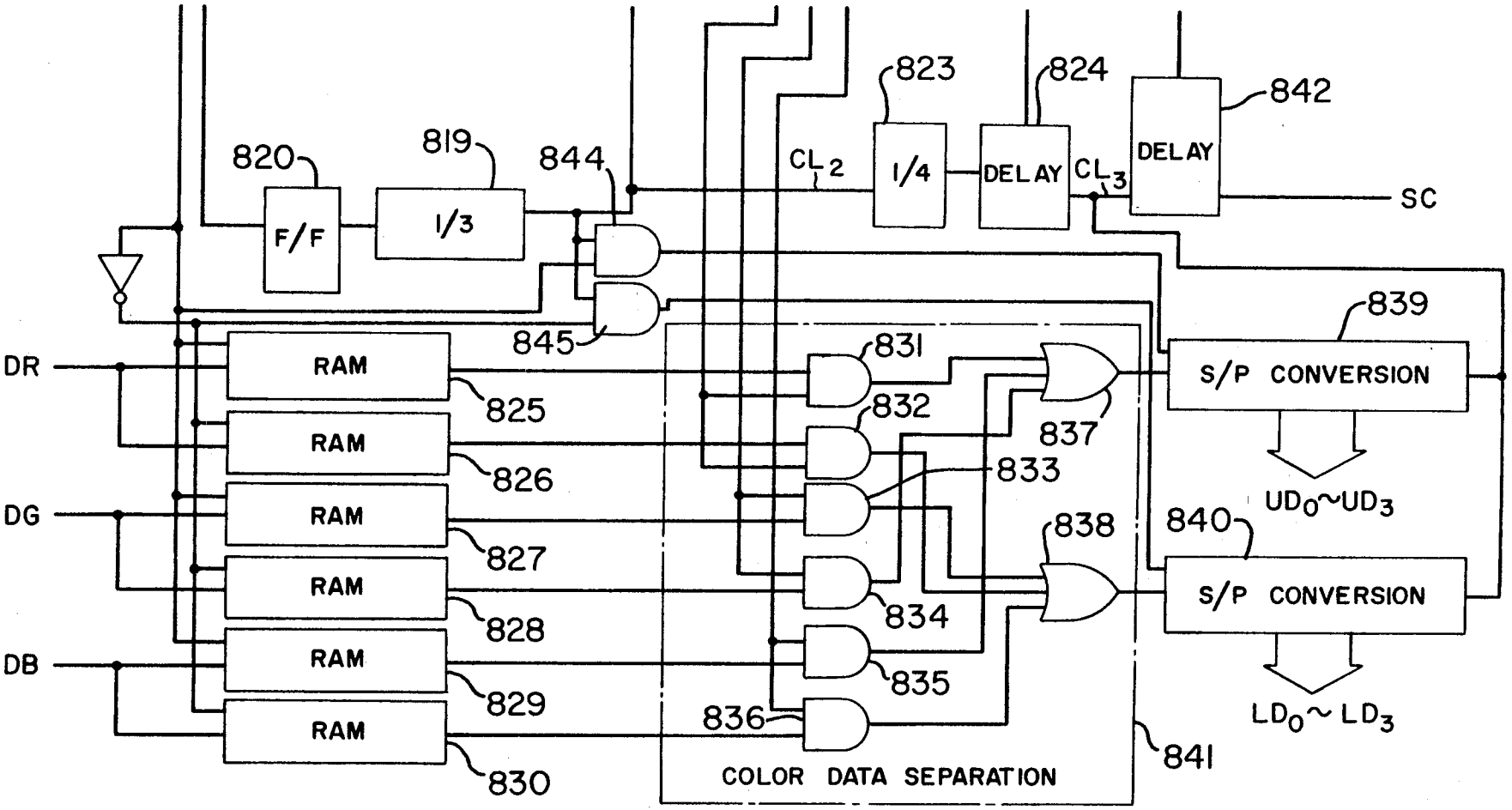
Figure 9A:
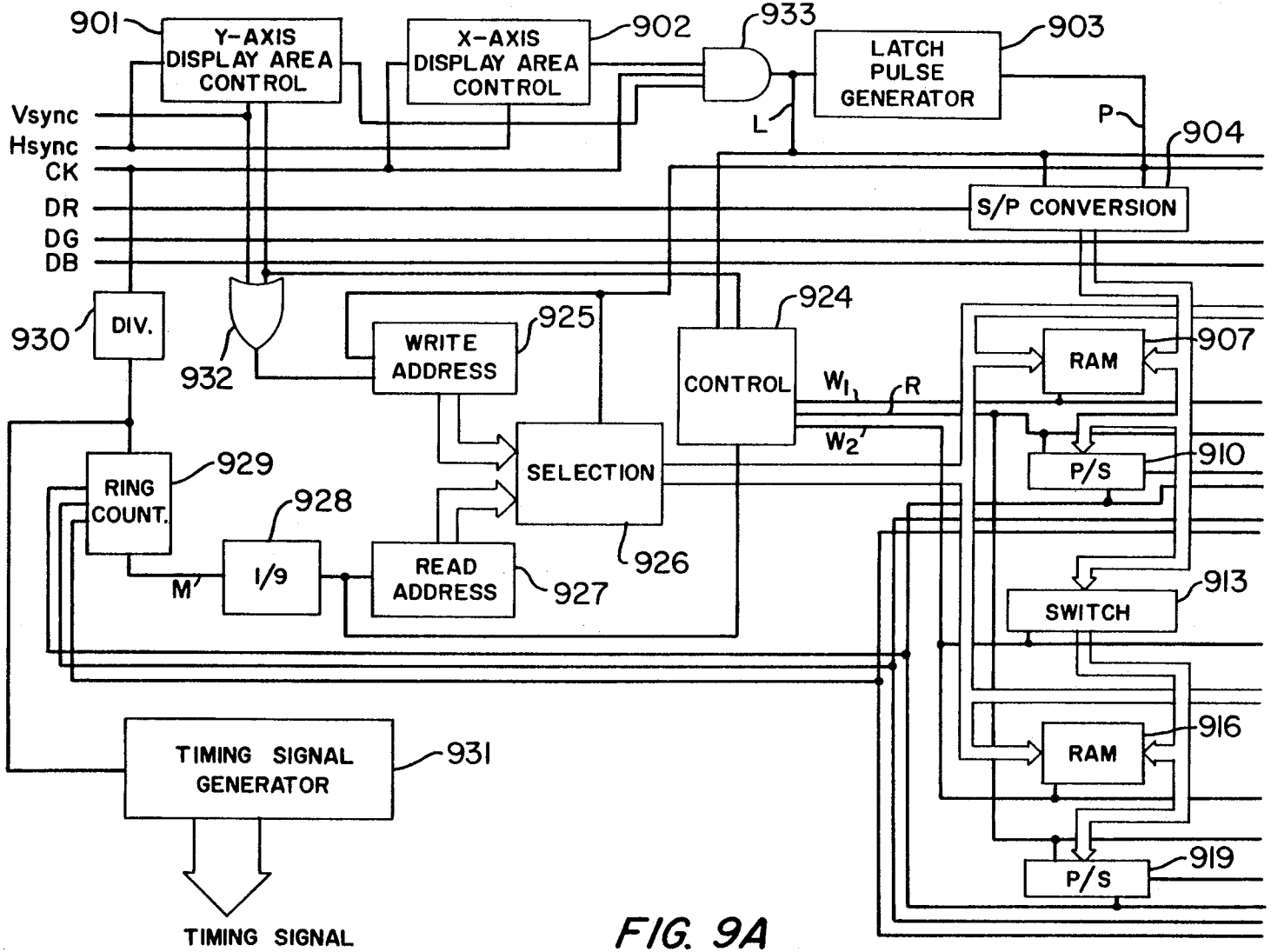
Figure 9B:
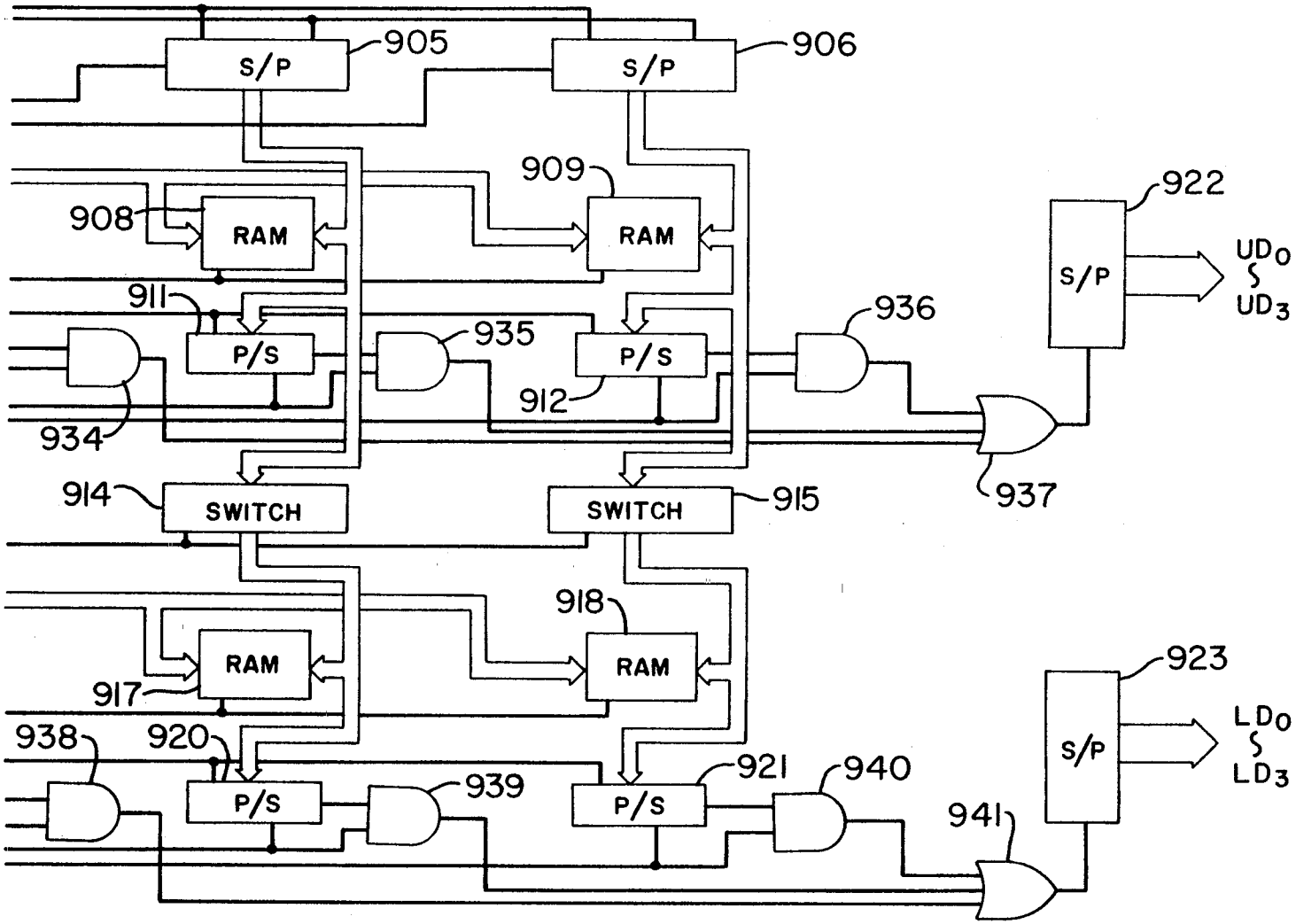

FIG. 6 is a block diagram showing an embodiment of a circuit including P/S changing circuits, selective gates and a ring counter.

FIGS. 7A–B, 8A–B and 9A–B are block diagrams showing other embodiments of the invention, respectively.

Figure 10:
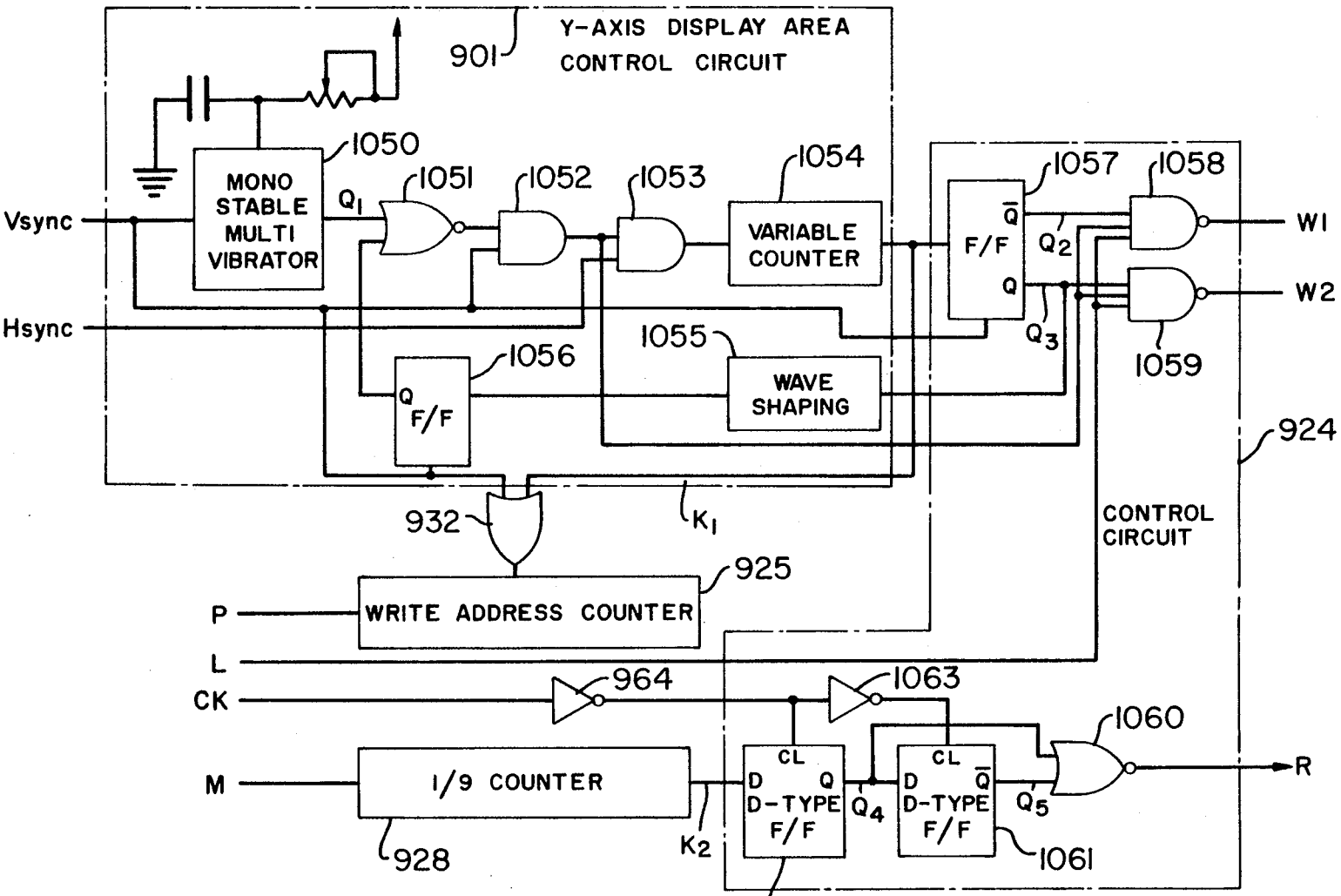

FIG. 10 is a block diagram showing an embodiment of the control circuit 924.

Figure 11:
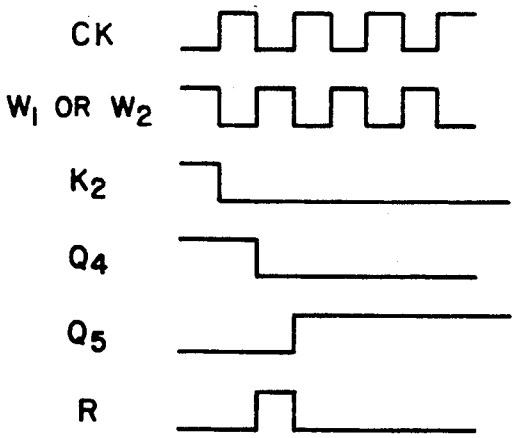

FIG. 11 is a timing chart for the control circuit.

Figure 12A:
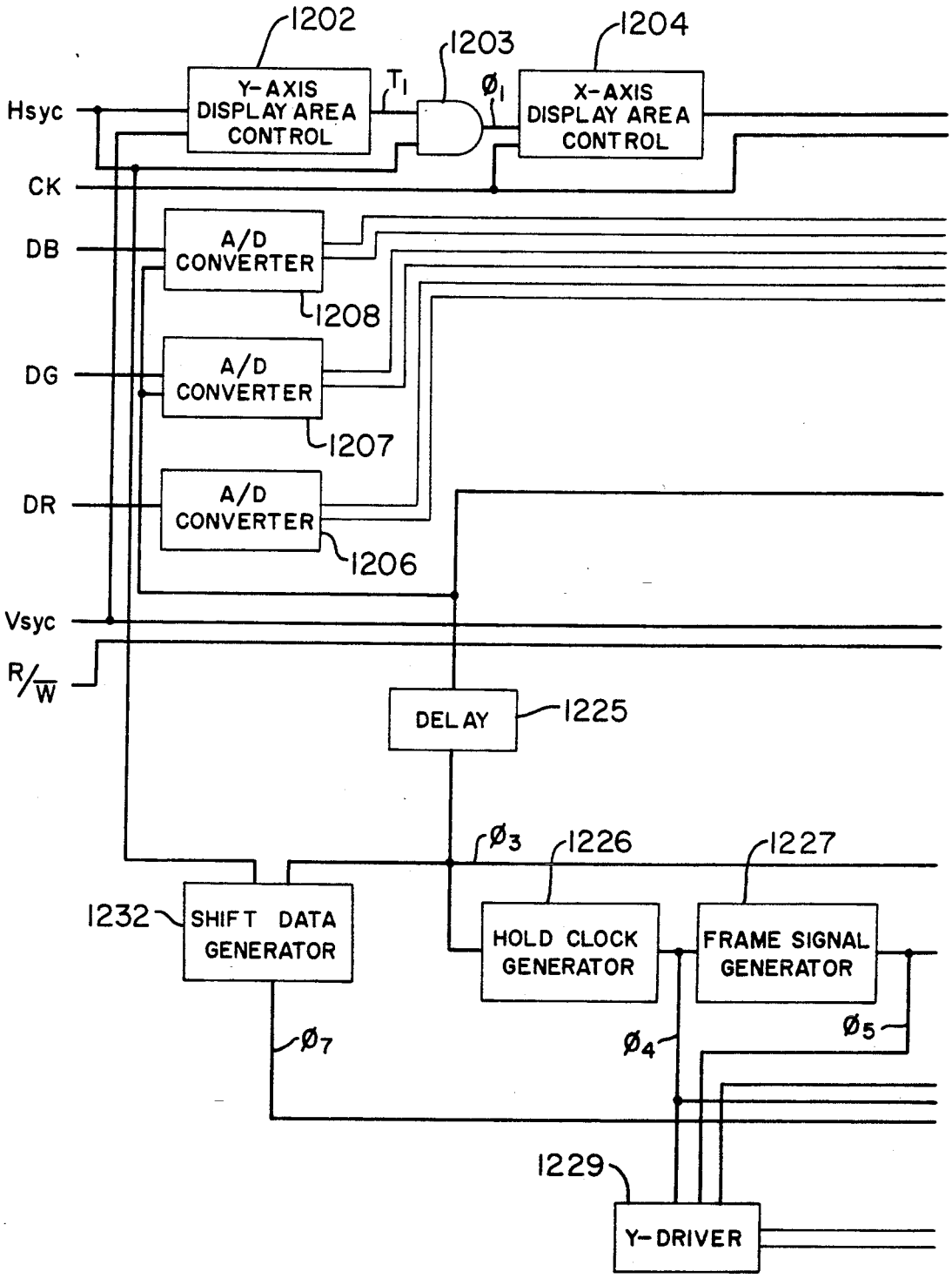
Figure 12B:
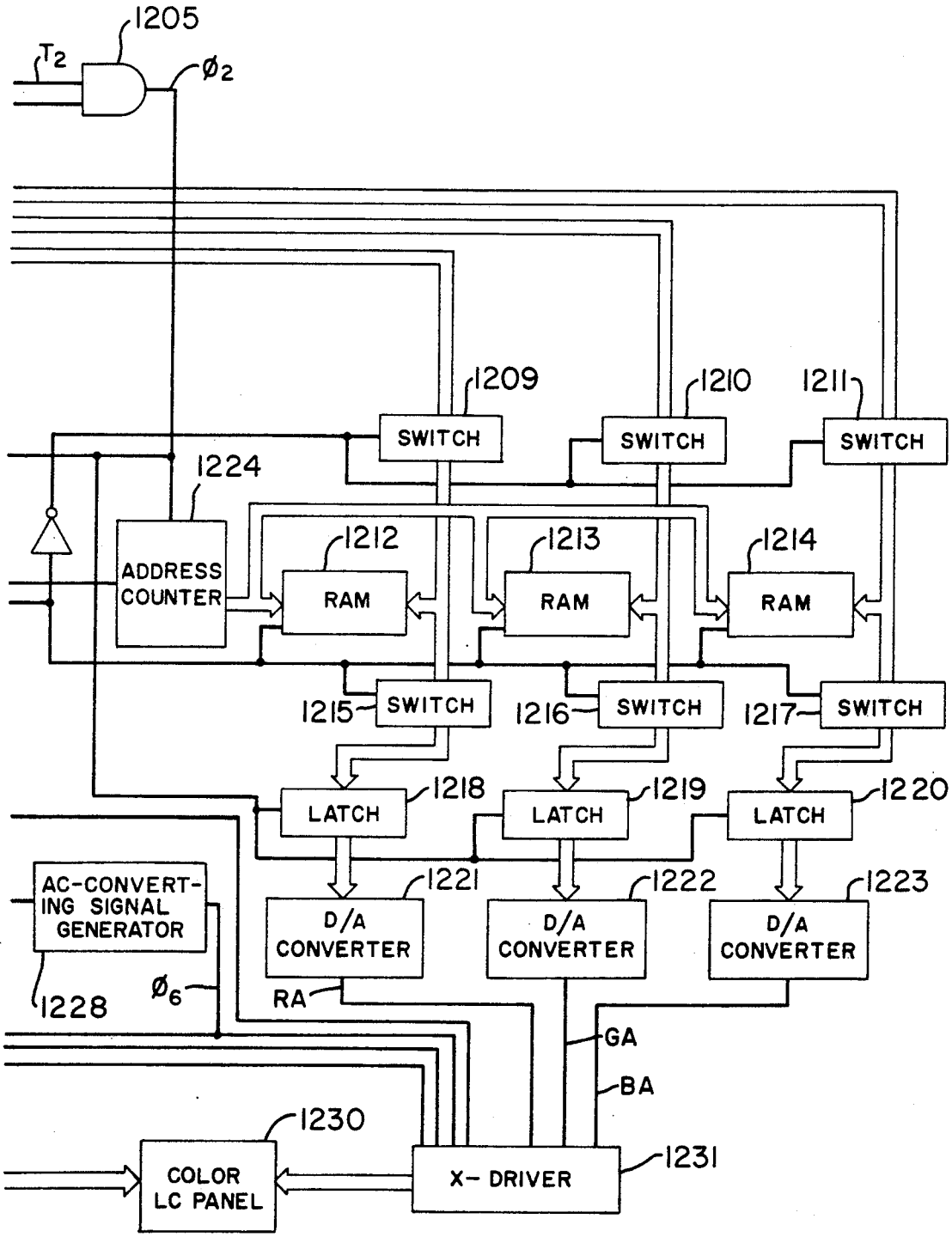

FIGS. 12A–B are a block diagram showing another embodiment of the invention.

Figure 13:
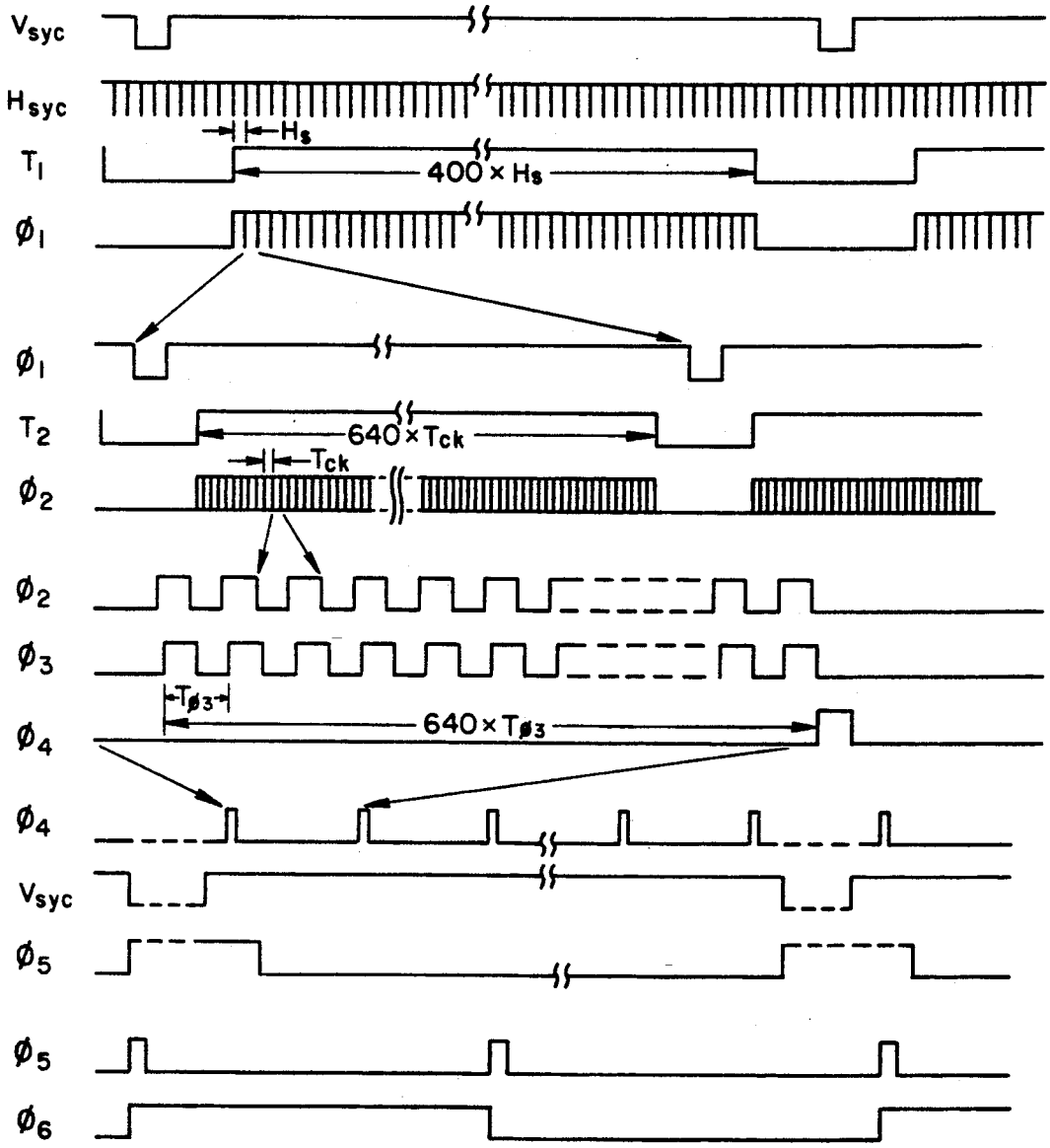

FIG. 13 is a timing chart for the circuit shown in FIG. 12.

Figure 14:
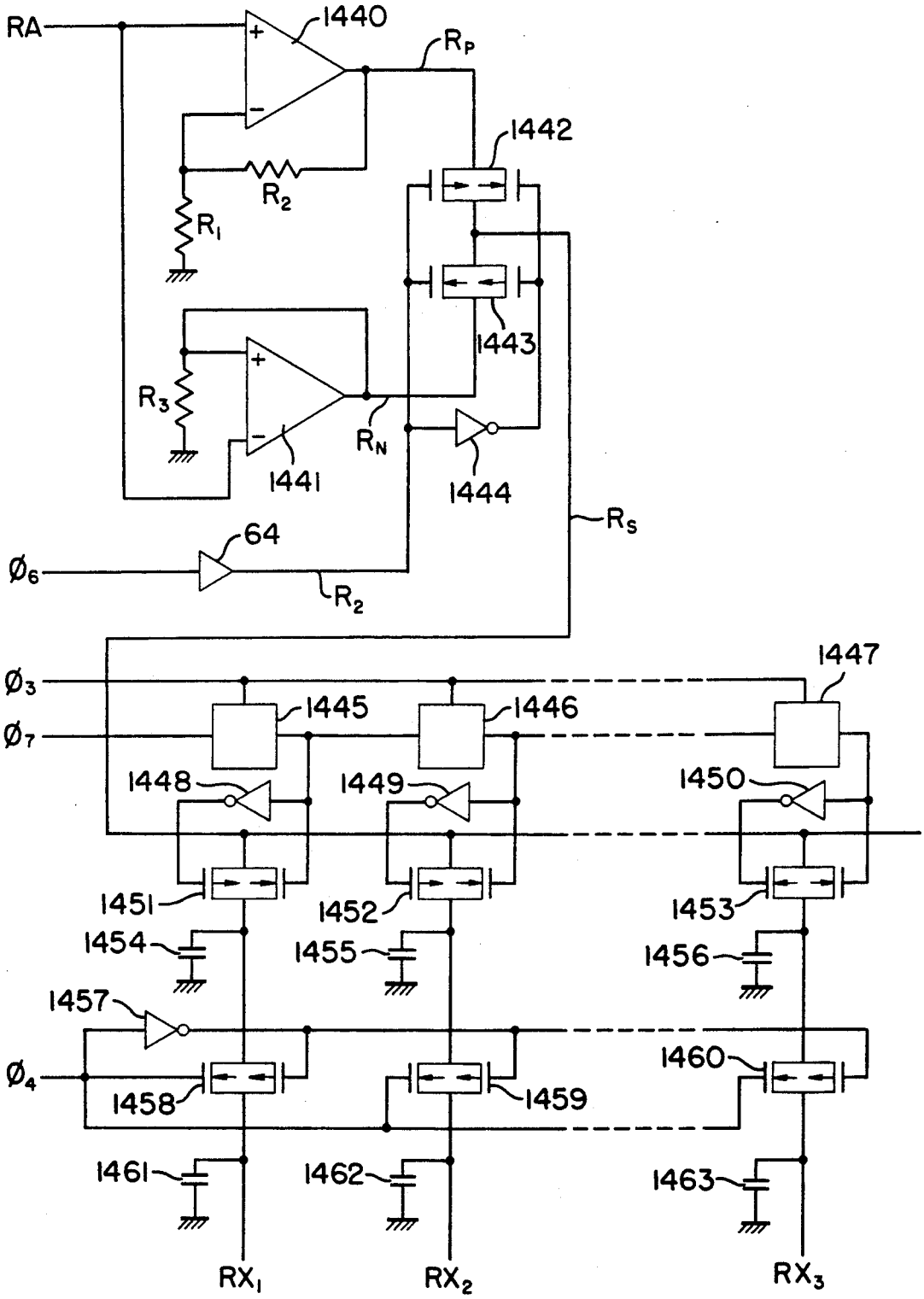

FIG. 14 is a block diagram showing an X axis driver.

Figure 15:
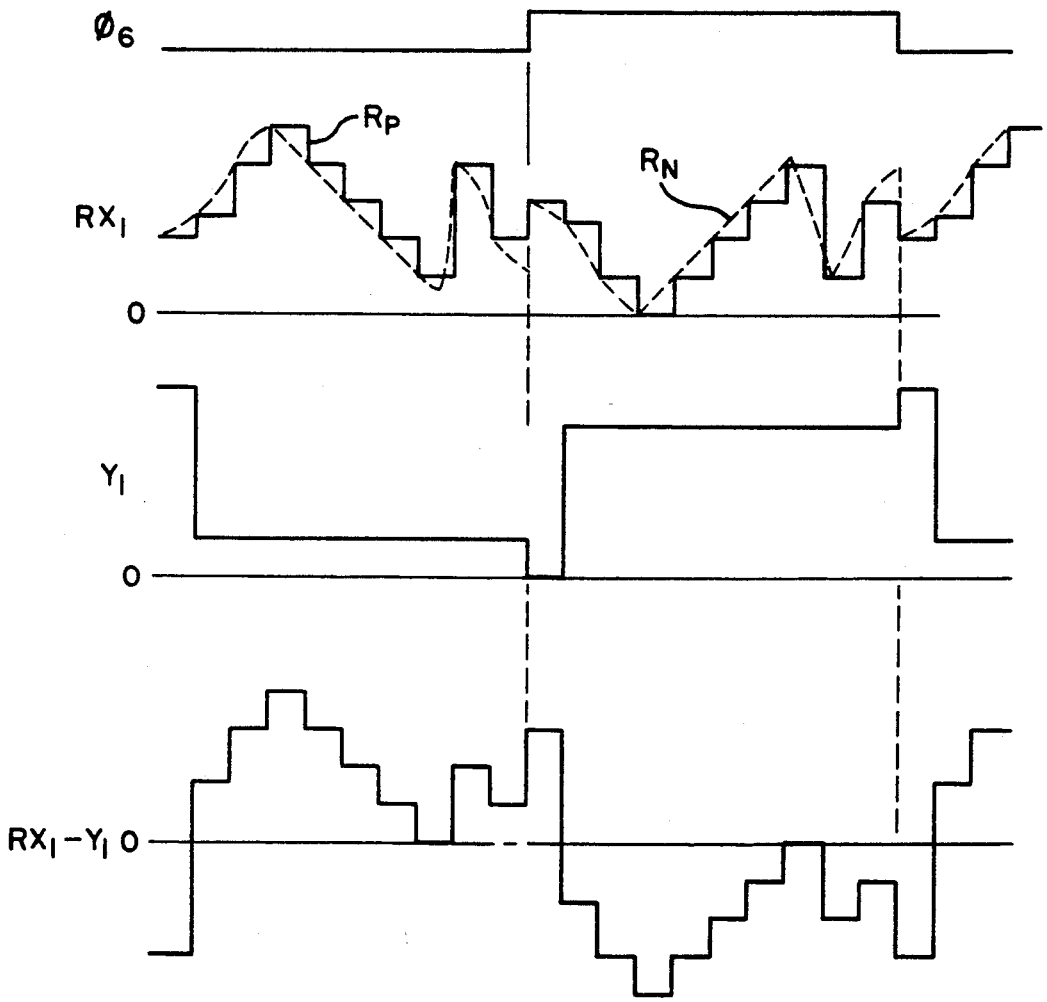

FIG. 15 shows a driving waveform.

DETAILED DESCRIPTION OF THE INVENTION

Next, an embodiment of the present invention will be described.

Figure 1:
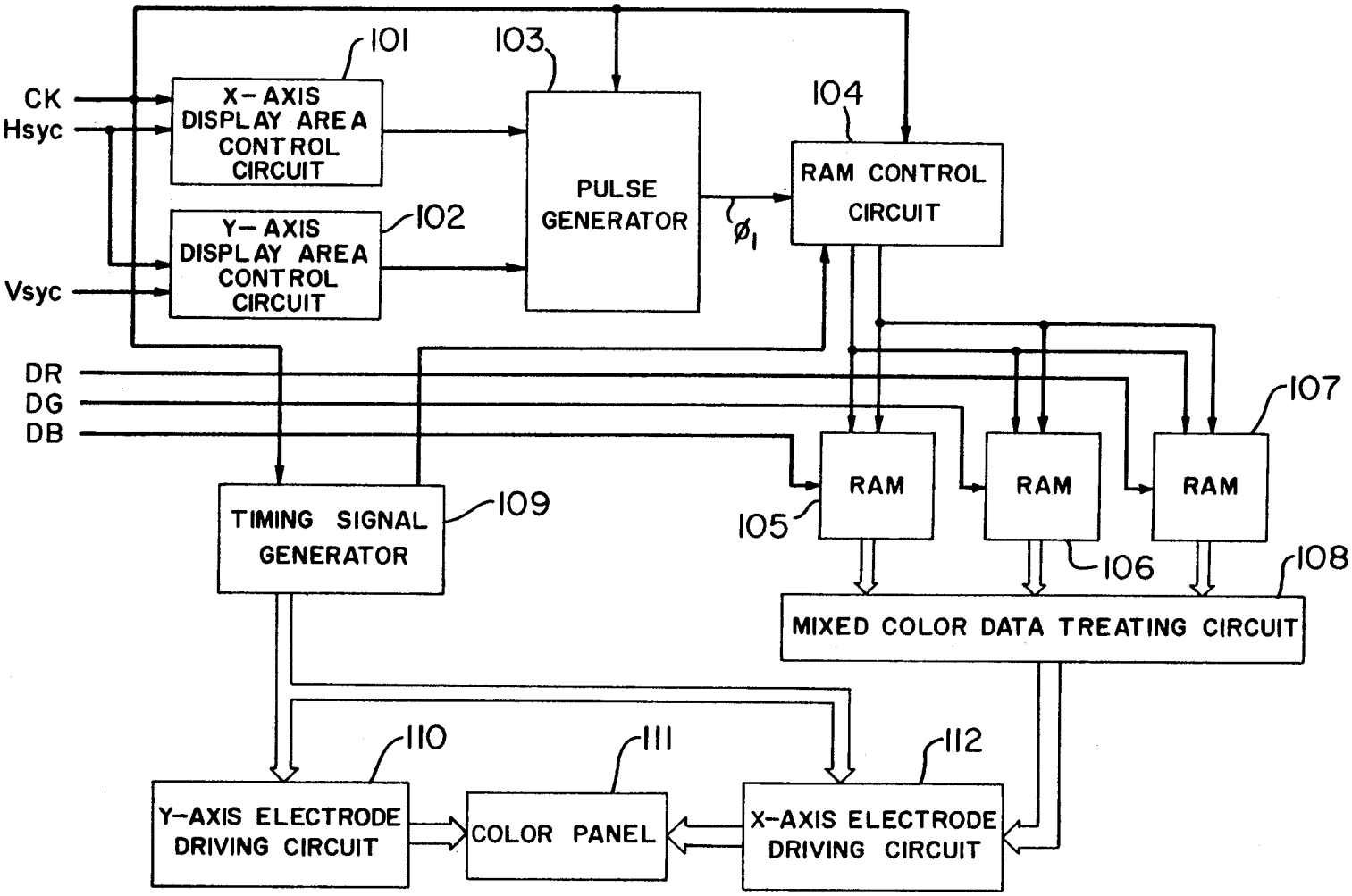
FIG. 1 is a block diagram showing one embodiment of the present invention.

FIG. 1 is a structural view showing the overall construction of a color liquid crystal display in accordance with the present invention. In the drawing, symbol Hsyc represents a horizontal sync signal; Vsyc is a vertical sync signal; and DR, DG and DB are red, green and blue display data signals, rspectively. Symbol CK represents a clock signal.

A Y-axis display area control circuit (a Y-axis home position regulating circuit) 102 is a control circuit that counts the horizontal sync signal Hsyc and determines a display area in the direction of Y-axis, and an X-axis display area control circuit (an X-axis home position regulating circuit) 101 is a control circuit that counts the clock signals CK and determines the display area in the direction of X-axis.

A pulse generator 103 is a circuit for generating a clock signal necessary for writing display data when both the aforementioned X-axis and Y-axis home position regulating circuits 101 and 102 are effective, i.e., after the blanking period. A RAM control circuit 104 is a circuit for generating an address signal, a write signal and a read signal necessary for writing and reading memory RAMs 105, 106 and 107. These memory RAMs 105, 106 and 107 are circuits for storing color display data DR, DG and DR. A mixed color data processor 108 is a circuit for rearranging the read data of the memory RAMs in the order of red, green and blue colors to transform them into the mixed color data. A timing signal generator 109 is a circuit for generating a timing signal necessary for the drives of an X-axis driver 112. The operations will be described in the following.

When both the outputs of the X-axis home position regulating circuit 101 and the Y-axis home position regulating circuit 102 are at the "H" level, i.e., when the horizontal and vertical sychronizing blanking periods elapse, the pulse generator 103 inputs the clock signal $\phi_1$ to the RAM control signal and write the color display data DR, DG and DB at a unit of eight bits in the memory RAMs 105, 106 and 107 respectively. The written display data are read for the period other than the writing period and inputted to the mixed color data processor 108. This mixed color data processor 108 transforms the red, green and blue data into the mixed color data at one unit and inputs them to the X-axis driver 112 to drive the X-electrodes of the color panel 111. The timing signal generator 109 generates both a timing signal necessary for driving the aforementioned X-axis driver 112 and Y-axis driver 110 and a read timing signal for reading the content of the memory RAMS 105, 106 and 107. The X-axis driver 112 can drive the X-electrodes of the color panel 111 on the basis of the display output data of the mixed color data processor 108, whereas the Y-axis driver 110 can drive the Y-electrodes of the colr panel 111 to display an image or a character.

Figure 2A:
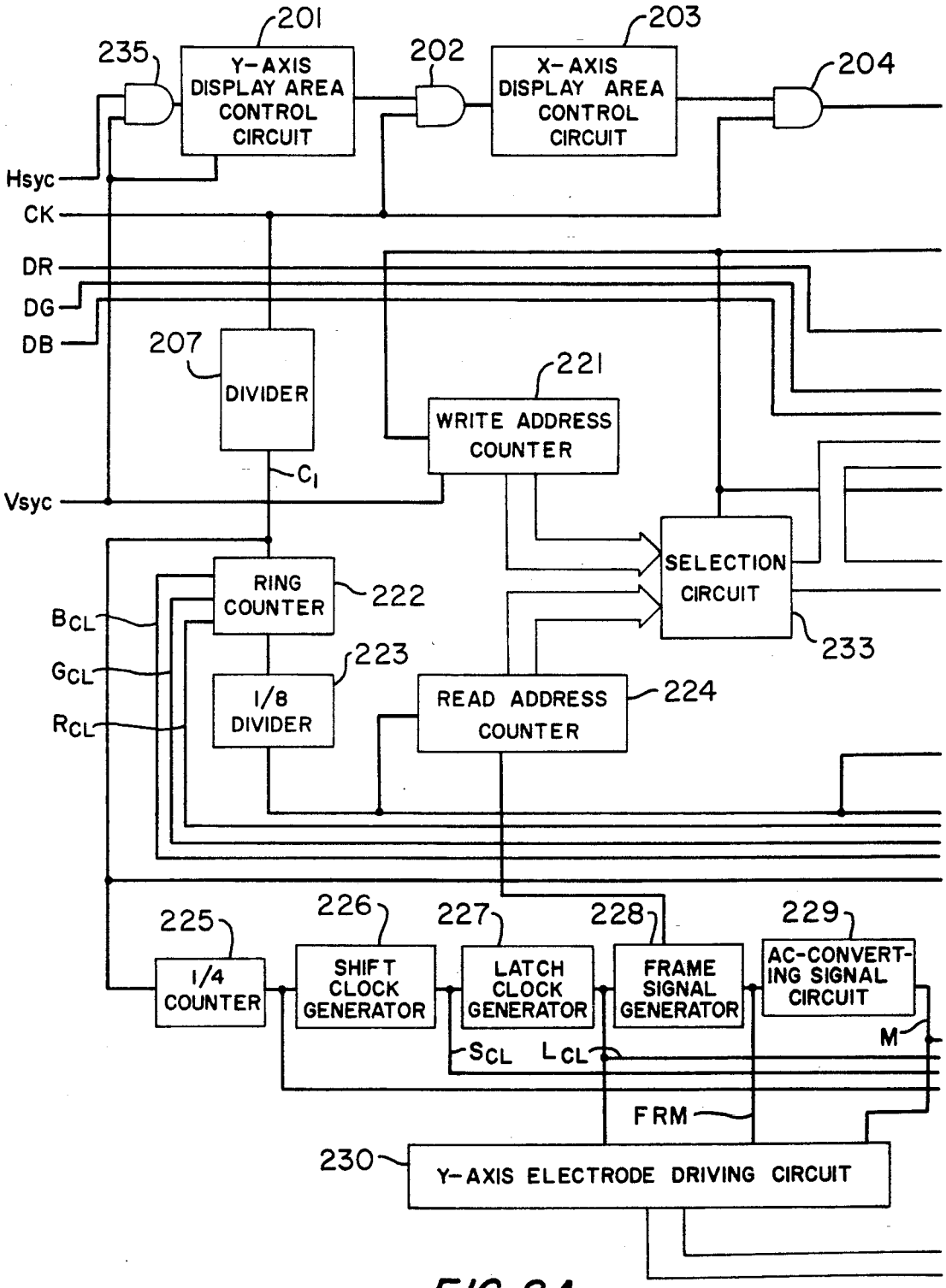
FIGS. 2A and 2B are a block diagram showing another embodiment of the invention.
Figure 2B:
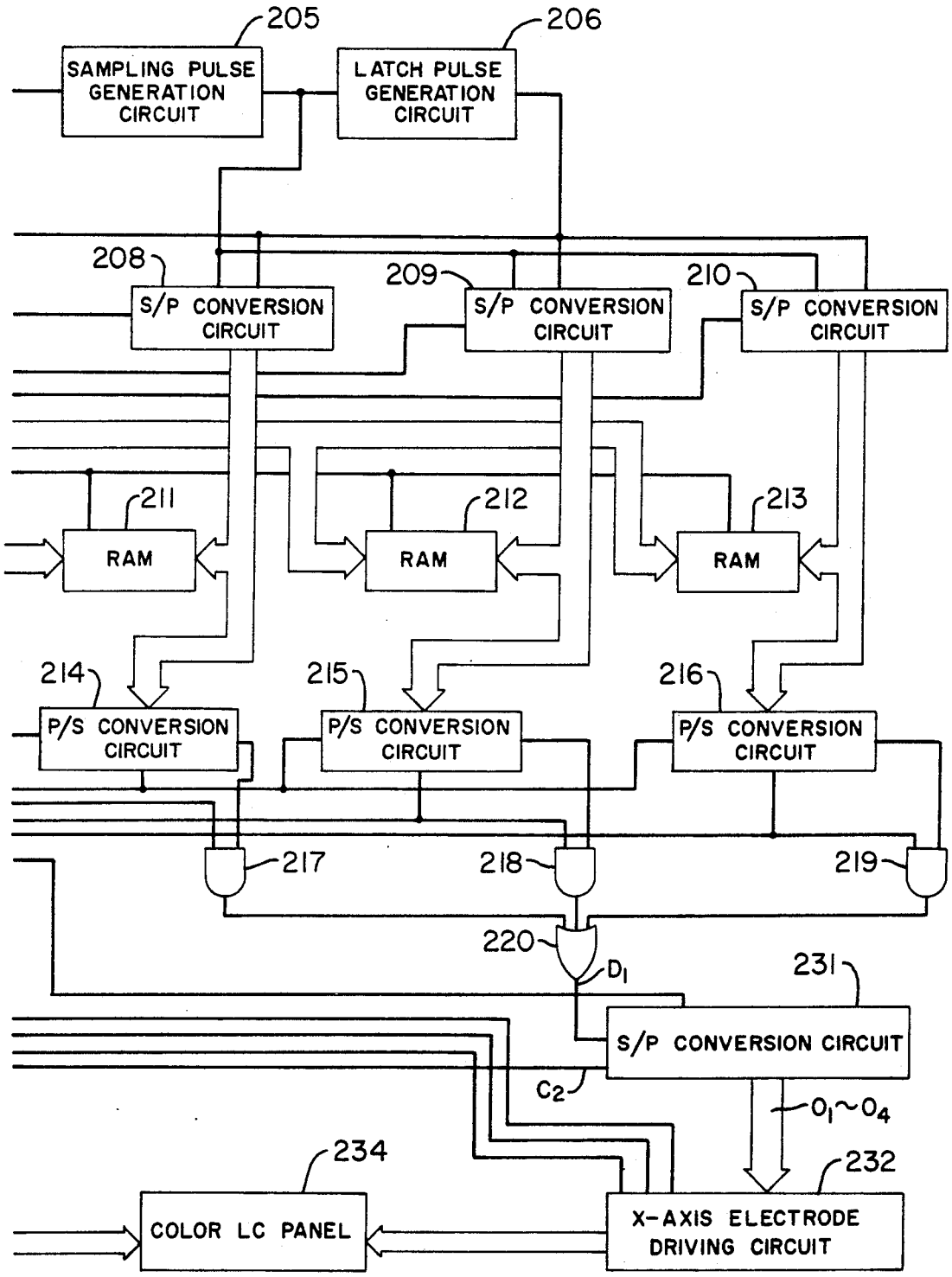

FIG. 2 shows one embodiment of the present invention.

A sampling pulse generation circuit 205 divides the frequency of the clock signal CK in a display area period and samples and receives data. S/P conversion circuits 208, 209 and 210 are conversion circuits for converting red, green and blue serial display data into parallel data, respectively. RAMs 211, 212 and 213 are memory circuits for storing the red, green and blue parallel data, respectively, while P/S conversion circuits 214, 215 and 216 convert the parallel data of the memory circuit RAMs 211, 212 and 213 to the serial data, respectively. AND circuits 217, 218 and 219 and an OR circuit 220 comprise a selection gate circuit that selectively and sequentially receives the outputs of the P/S conversion circuits 214, 215, 216 and produces serial data as the mixture of red, green and blue data, respectively.

An S/P conversion circuit 231 converts the serial mixed display data to the parallel data. A write address counter 221 is reset by the vertical sync signal Vsyc and then counts the addresses of the memory circuits RAMs 211, 212, 213. A latch pulse generation circuit 206 generates a latch pulse whenever it counts eight sampling pulses of the sampling pulse generation circuit 205 and latches the registers of the S/P conversion circuits 208, 209, and 210. Furthermore, the latch pulse from the latch pulse generation circuit 206 is inputted to the write address counter 221.

A read address counter 224 is a counter circuit for the read-out address of the memory circuit RAMs 211, 212, 213. A selection circuit 233 is a circuit that switches the address line for selectively writing and reading data into and from the adresses of the memory circuits RAMs 211, 212, 213. A frequency division circuit 207 divides the frequency of the clock signal CK to a lower frequency. A ring counter 222 consists of a ternary ring counter and generates a selection pulse in order to obtain the mixed serial display data from the selection gate circuit 217, 218, 219, 220 by sequentially retrieving the red, green and blue display data from the P/S conversion circuits 241, 215, 216. A $\frac{1}{8}$ counter 223 generates a latch siganl for latching the display data of the counter input signal of the read address counter 224 and the display data of the memory circuit RAMs 211, 212, 213 to the P/S conversion circuits 214, 215, 216, and produces one pulse signal whenever 8 pulses of the carry signals of the ring counter 222 are inputted.

A $\frac{1}{4}$ counter 225 supplies a latch signal $C_2$ to the S/P conversion circuit 231 whenever four output pulses of the frequency division circuit 207 are inputted thereto, and a shift clock generator 226 generates a shift clock signal for a shift register of a 4-bit parallel type that is incorporated in an X electrode driving circuit 232. A latch clock generator 227 generates a latch signal for latching the data of the X-axis electrode driving circuit 232 and a Y-axis electrode driving circuit 230, and a frame signal generation circuit 228 generates a frame signal (data for the Y-electrodes) to the Y electrode driving circuit 230.

An AC-converting signal circuit 229 changes the polarity of the driving signals for the X- and Y-electrode driving circuits 232 and 230 in order to drive, by AC, a color liquid crystal panel 234. The color liquid crystal panel 234 is produced by forming red, green and blue filters on transparent electrodes of the X-axis electrodes. The X electrode driving circuit 232 drives the X-axis electrodes of the liquid crystal panel 234 while the Y electrode driving circuit drives the Y-axis electrodes.

Next, the operation of the present invention will be described.

The Y-axis display area control circuit 201 receives Hsyc as its input through AND gate 235 and outputs a signal determining the Y-axis effective display area to the AND circuit 202.

The clock signal as the output of the AND circuit 202 is inputted to the X-axis area control circuit 203, which outputs the signal determining the X-axis effective display area to the AND circuit 204. Here, since both the Y-axis display area control circuit 201 and the X-axis display area control circuit 203 consist of variable counters, the effective display ranges for the color liquid crystal panel in the X- and Y directions can be set arbitrarily. Next, the output of the AND circuit 204 is the clock signal in the effective display area, and hence the display data DR, DG and DB are effective.

The sampling pulse generation circuit 205 divides the frequency of the output of the AND circuit 204 into $\frac{1}{4}$ to generate the sampling pulse, and generates the data sampling pulse as the shift clock of the S/P conversion circuits 208, 209, 210. The latch pulse generation circuit 206 divides the frequency of the sampling pulse of the sampling pulse generation circuit 205 into $\frac{1}{8}$ and produces the latch signal to the S/P conversion circuits 208, 209, 210.

Furthermore, this latch pulse is inputted to the write address counter 221, the selection circuit 233 and the memory circuit RAMs 211, 212, 213. Therefore, the 8-bit parallel signals from the S/P conversion circuit are fed to predetermined addresses and are simultaneously stored in the memory circuits 211, 212, 213. Whenever these signals are stored, the write address counter 221 is incrementally advanced by the latch pulse of the latch pulse generation circuit 206 and the display data are sequentially stored at the predetermined addresses.

Next, the read operation will be described. When the no latch pulse output of the latch pulse generation circuit 206 exists, the selection circuit 233 selects the count output of the read address counter 224 and the memory circuits RAMs 211, 212, 213 are held in the read mode. Therefore, the display data of these memory circuit RAMs 211, 212, 213 are addressed by the output of the read address counter 224 and are inputted to the P/S conversion circuits 214, 215, 216. The display data are latched into the P/S conversion circuits 214, 215, 216 in response to the output of the $\frac{1}{8}$ divider 223.

The frequency division signal $C_1$, that is generated by dividing the frequency of the dot clock signal CK by the frequency division circuit 207, is inputted to the ring counter 222.

The ring counter 222 consists of the ternary ring counter as described already, and this output is used as the shift clock signal of each of the P/S conversion circuits 214, 215, 216. Accordingly, the serial signals of the P/S conversion circuits 214, 215, 216 are inputted regularly and sequentially to the AND circuits 217, 218, 219 of the selection gate circuit together with the signal of each ternary ring counter. For this reason, the OR circuit 220 of the selection gate circuit outputs the serial data D1 (FIG. 4) which are the mixture of the display data of red, green, blue, red, . . . , blue. The mixed red, green and blue serial data D1 are inputted to the S/P conversion circuit 231. The output C2 (FIG. 4) after division of the frequency into ¼ by the ¼ counter 225 is inputted as the latch signal to the S/P conversion circuit 231 so that this conversion circuit 231 converts the mixed serial display data D1 into parallel data such as (red, green, blue, red), (green, blue, red, green), (blue, red, green, blue), (red, green, blue, red) . . . and so forth.

Figure 4:
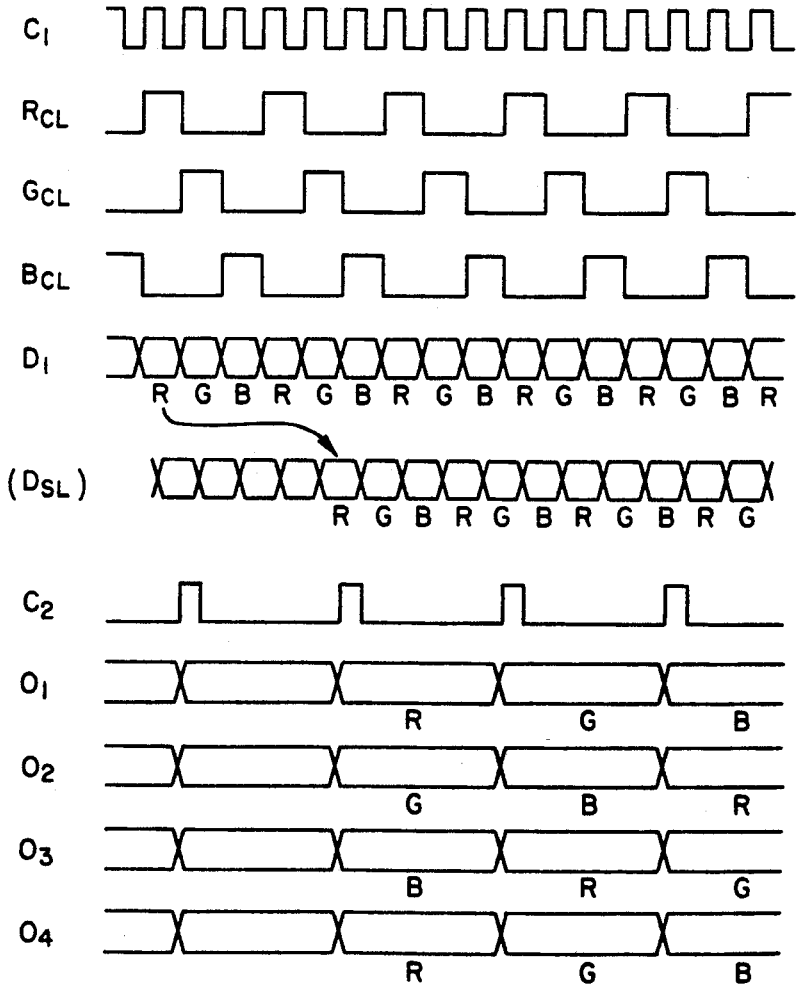
FIG. 4 is a timing chart of display data.

The S/P conversion circuit 231 outputs 4-bit parallel mixed color display data $O_1$–$O_4$ as shown in FIG. 4.

The shift clock generator 226 generates the shift clock $S_{CL}$ by delaying the output signal of the ¼ counter 225 in order to supply the shift clock to the shift register of the 4-bit parallel type of the X-electrode driving circuit 232 for the display data of the S/P conversion circuit 231.

The latch clock generator 227 generates the latch signal $L_{CL}$ in order to latch the display data of the 4-bit parallel shift register of the X electrode driving circuit 232. When the display data of the X-axis electrode is shifted to its end, the latch clock generator 227 generates the latch clock, whereby the display data are simultaneously latched and the X electrodes are driven at the same timing. Furthermore, the display data of the Y-axis electrodes are shifted, and the shift clock signal for driving the next Y-axis electrode is generated. The frame signal generation circuit 228 generates the frame signal FRM which becomes the display data of the Y electrode driving circuit 230, and produces the display data for selecting the first Y-axis electrode by dividing the frequency of the latch clock generator 227. Furthermore, the frame signal generation circuit 228 clears the output of the read address counter 224 to 0 and generates the reset pulses for turning the addresses of the memory circuit RAMs 211, 212, 213 to the zero address.

Figure 3:
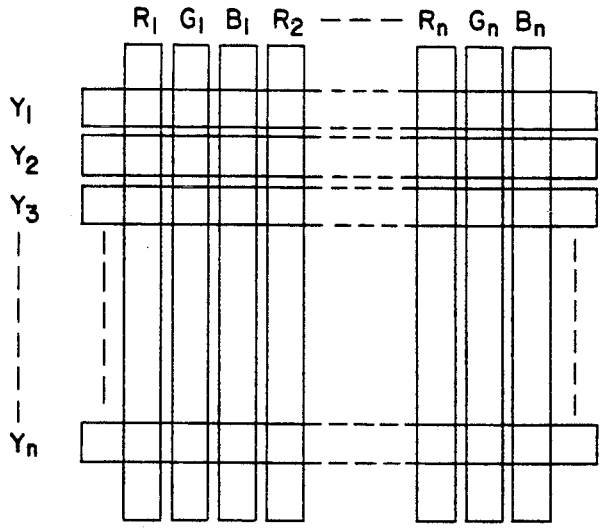
FIG. 3 is a plan view showing electrodes construction of a multi-color LC panel.

FIG. 3 is a diagram showing the electrode construction of a color liquid crystal panel used in the present invention. In FIG. 3, reference characters $Y_1$, $Y_2$, - - - , and $Y_n$ denote the grouped Y-electrodes of the color liquid crystal panel. Characters $R_1$, $G_1$ and $B_1$, $R_2$, $G_2$ and $B_2$, - - - , and $R_2$, $G_n$ and $B_n$ denoted the grouped X-electrodes having the color filters applied thereto in the order of the red, green and blue colors, and the intersections between the aforementioned X-electrodes and Y-electrodes provide color display dots.

FIG. 4 is a timing chart showing the timings at which the mixed color display data D1 and the 4-bit parallel red, green and blue data $O_1$–$O_4$ are outputted. In FIG. 2, the outputs $R_{CL}$, $G_{CL}$ and $B_{CL}$ of the ring counter 222 are obtained from the output $C_1$ of the divider 207, and the display data are retrieved in a time sharing manner by the selecting gate circuit. As a result, the output $D_1$ of the OR circuit 220 outputs the display data of R (red), G (green) and B (blue) colors sequentially, as shown in the timing chart. The aforementioned display data $D_1$ are latched by the output signal $C_2$ of the ¼ counter 225 if they are shifted by 4 bits (to $D_{SC}$) by the shift clock $C_2$ of the S/P converter 231. As a result, the 4-bit parallel outputs $O_1$ to $O_4$ of the S/P converter 231 can output the mixed color display data, as can be understooed from FIG. 4, such that: the $O_1$ output in the order of R, G and G; the output $O_2$ in the order G, B and R; the output $O_3$ in the order of B, R and G; and the output $O_4$ in the order R, G and B.

Figure 5:
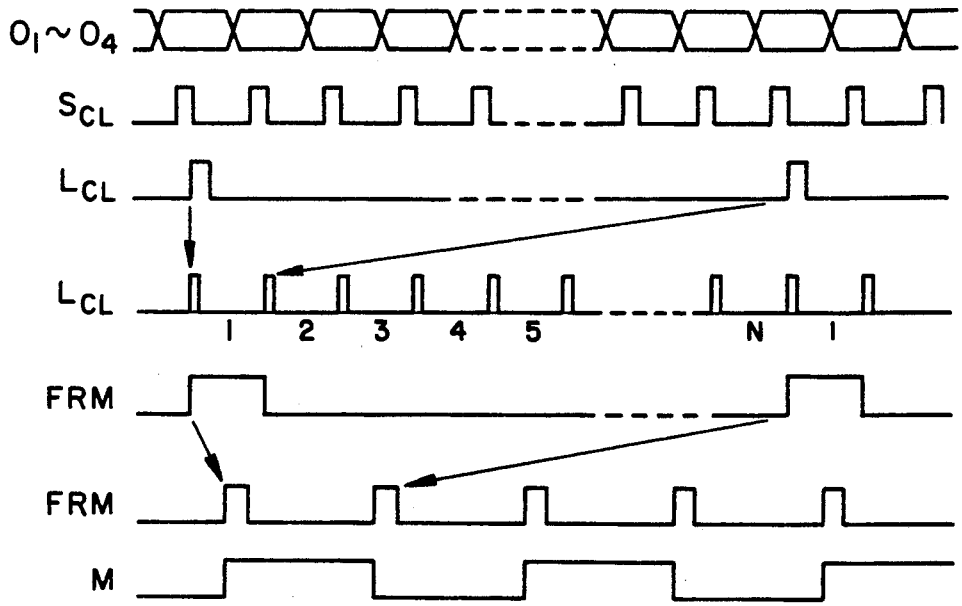

FIG. 5 is a timing chart showing interface signals to the liquid crystal driver. In FIG. 5, reference characters $O_1$ and $O_4$ denote the mixed color display data of the S/P converter 231. Reference $S_{CL}$ denotes the shift clock of a 4-bit parallel shift register built in the X-axis driver 232. Reference $L_{CL}$ denotes the latch signal of a latch circuit built in the X-axis driver 232 and the shift clock of a shift register built in the Y-axis driver 230. Reference FRM denote scan starting data for starting the scanning of the Y-axis driver 230, which are generated by the frame signal generator 228 of FIG. 1.

Symbol M represents a signal obtained by halving the FRM signal described above, and is the output signal of the AC-conversion signal generation circuit shown in FIG. 2.

FIG. 6 shows the construction of P/S converters 614, 615 and 616, a selecting gate circuit and a ring counter 622 in accordance with a specific embodiment of the present invention.

In FIG. 6, a switch 645 is a change-over switch for converting the counted value of the ring counter 622 into a binary or ternary value. A resistor 646 is a pull-down resistor. Memory RAMs 611, 612 and and 613 store therein parallel data which is latched by the P/S converters 614, 615 and 616. The counted ternary output of the ring counter is fed to AND circuits 640, 641 and 642 to produce shift clocks for the P/S converters 614, 615 and 616 to transfer the data of the P/S converters 614, 615 and 616 sequentially and serially through AND circuits 617, 618 and 619 to an OR circuit 620 and to S/P conversion circuit 631. The output of the aforementioned ring counter 622 is inputted to a 1/9 counter 623 to output one pulse each time the nine outputs $CL_1$ of the ternary counter 622 is counted. As a result, with no output from the 1/9 counter 623, through investor 643 the AND circuits 640, 641 and 642 are opened to send the shift clock to the P/S converters 614, 615 and 616 but are closed at the 9th count. And, the output $CL_2$ of the 1/9 counter is inputted to the memory RAMs 611, 612 and 613 so that the data from these memory RAMs 611, 612 and 613 are simultaneously outputted to the P/S converters 614, 615 and 616. The output $CL_2$ of the 1/9 counter is delayed to produce an output $CL_3$ by a delay circuit 644. This output $CL_3$ causes the parallel data of the aforementioned memory RAMs 611, 612 and 613 to the latched as new data in the P/S converter. Thus, the parallel data of the memory RAMs 611, 612 and 613 are 8-bit data so that the new data are transferred for the period of the ternary ring counter $CL_1$ each time eight shots of shift clock are inputted to complete the shifting operation. Although the description thus far made is directed to the example of the ternary ring counter, the ring counter 622 operates similar to the aforementioned ones as a binary ring counter when the switch 645 is turned on.

In FIG. 2, the output of the OR circuit 220 of the selecting gate circuit is the serial data in which the display data of red, green and blue display data are mixed. These serial data are inputted to the S/P converter 231. Since the output having its frequency divided into one quarter by the ¼ counter 225 is inputted as the latch of the S/P converter 231, this converter 231 transforms the display data into a parallel form such as (red, green and blue, red), (green, blue, red, green), (blue, red, green, blue), (red, green, blue, red)—, and so on.

FIG. 7 shows another embodiment of the present invention. Elements 701–710, 721–730, 732–734 function the same as the corresponding elements 201–210, 221–230 and 232–234 in FIG. 2. In FIG. 7, a ring counter 722 is a hexanary ring counter for generating a switching signal in a time sharing manner. Divider 707 receives clock pulses from AND gate 736 with one input connected to inverter 737. Latch circuits 714, 715 and 716 are circuits for temporarily storing the display data read from RAMs 711, 712 and 713. Switch circuits 740 through 745 circuits are operative to receive the display data stored in the latch circuits 714, 715 and 716 from the lowermost bit in the order of the red, green and blue data as the serial mixed color display data in response to outputs from a delay circuit 735 to rearrange the serial mixed color display data in a time sharing manner so that the switch circuits 740 through 745 have a function to convert the serial mixed color display data into the parallel mixed color display data like the P/S converters 214, 215 and 216, the selecting gate circuit 217, 218, 219 and 220, the S/P converter 231 and the ring counter 222, shown in FIG. 2.

FIG. 8 is a circuit diagram showing another embodiment. In FIG. 8, an X-axis home position regulating circuit 801 is a circuit for receiving the horizontal synchronizing signal Hsyc to provide a predetermined delay time thereby to take a timing with the color display data. A Y-axis home position regulating circuit 802 receives the vertical synchronizing signal Vsyc to provide a predetermined delay time from the timing of the signal Vsyc thereby to take a timing with the display data. A variable dot counter 803 is a circuit for counting the number of the clock signals CK to count the number of the horizontal dot clocks. A flip-flop circuit 815 is a circuit for dividing the frequency of the clock CK or the output of an AND circuit 807. A phase comparator 816, an integrator 817, a voltage-controlled oscillator 818, a $\frac{1}{3}$ counter 819 and a flip-flop circuit 820 constitute together a PLL circuit to generate a signal having a frequency three times as high as that of the clock signal of the aforementioned AND circuit 807. A ring counter 821 is a ternary ring counter circuit for outputting the control signal of a color separator 841 in response to the oscillating signal of the aforementioned PLL circuit. Memory circuits 825 to 830 are memories for storing the color display data DR, DG and DB. The color data separator 841 is a circuit composed of AND circuits 831 to 836 and OR circuits 837 and 838 and is operative to effect separations of the color data of the upper and lower electrodes. S/P converters 839 and 840 are circuits for converting the serial data from the aforementioned OR circuits 837 and 838 into parallel data to output the color-separated data to the liquid display. The present embodiment is constructed of the circuit components described above.

The operations will be described in the following.

When the horizontal synchronizing signal Hsyc is inputted to a monostable multivibrator 804 of the X-axis home position regulator 801, the output of the monostable multivibrator 804 falls to the "0" level with a delay time CR determined by a capacitor and a variable resistor. Since a flip-flop circuit 808 is set by the signal Hsyc, the output of a NOR circuit 805 rises to the "1" level. The Y-axis home position regulating circuit 802 also has a similar construction and inputs the value "1" to an AND circuit 807 with a delay time after it receives the vertical synchronizing signal Vsyc.

As a result, the AND circuit 807 outputs the clock signal CK after the outputs of the X-axis and Y-axis home position regulating circuits 801 and 802 become coincident with the "1" level. In case, moreover, the count value of the variable dot counter 803 is set at 640, the carry signal $CL_1$ is generated by the 640th clock signal CK. This carry signal $CL_1$ sets the output of the flip-flop circuit 808 at "1" level so that the AND circuit 807 interrupts the output of the clock signal CK.

The clock signal CK of the aforementioned AND circuit 807 is inputted to the flip-flop circuit 815 so that it produces a frequency signal divided into a square wave signal having a duty ratio of 1:1 and the square wave signal is inputted to the phase comparator 816. This phase comparator 816 compares the phases of the flip-flop circuits 815 and 820 so that its output is integrated by the integrator 817. The integrated voltage is outputted to the voltage controlled oscillator 818 so that an oscillating signal proportional to the integrated voltage is generated. The $\frac{1}{3}$ counter circuit 819 divides the frequency of the oscillating signal of the voltage-controlled oscillator 818 to $\frac{1}{3}$, and this divided signal is further divided into a square wave signal having a duty ratio of 1:1 and inputted to the phase comparator 816 in which the square wave signal is compared again with the output of the flip-flop circuit 815. Since the aforementioned PLL circuit has the operations thus far described, the voltage-controlled oscillator 818 outputs a signal oscillating with a frequency three times as high as that of the clock signal CK to the ring counter 821.

On the other hand, red, green and blue video signals DR, DG and DB are stored in the memories 825 to 830. These memories 825 to 830 are constructed of shift registers, and the shift clock signal is applied thereto from the output of the aforementioned flip-flop circuit 815 so that the data are shifted alternately in the memories for each one clock. More specifically, the display data DR, DG and DB are shifted and stored in response to odd clocks in the individual memories 825, 827 and 829 and stored in response to even clocks in the individual memories 826, 828 and 830. The shifted output data of the memories 825, 827 and 829 are inputted to the AND circuits 831, 833 and 835 of the color data separator 841. Since the other inputs of the AND circuits 831, 833 and 835 receive the individual output signals of the ring counter 821, the data of the memories 825, 827 and 829 are inputted to the S/P converters 839, 840 and 839, respectively, in a time sharing manner. Next, the data of the memories 826, 828 and 830, which are stored in response to the clock signals of even orders, are likewise inputted to the S/P converters 839 and 840 in a time sharing manner. More specifically, the data of the memories 826, 828 and 830 are inputted to the S/P converters 840, 839 and 840, respectively. The respective shift clock signals of the S/P converters 839 and 840 are the outputs of AND circuits 844 and 845. The S/P converters 839 and 840 are latched by the latch signal $CL_3$ which is delayed by a delay circuit 824 via inverter 843 from the output $CL_2$ of the voltage-controlled oscillator 818 and the carry signal of a $\frac{1}{4}$ counter 823. As a result, the S/P converters 839 and 840 divide the color display data into those for upper and lower electrodes, respectively, to generate outputs $UD_0$ to $UD_3$ and $LD_0$ to $LD_3$. Specifically, the outputs of the S/P converter 839 are DR (of the terminal $UD_0$), DB (of $UD_1$), DG (of $UD_2$), DR (of $UD_3$), DB (of $UD_0$), DG (of $UD_1$),—, and so on. On the other hand, the outputs of the S/P converter 840 are DG (of the terminal $LD_0$), DR (of $LD_1$), DB (of $LD_2$), DG (of $LD_3$), DR (of $LD_0$, DB (of $LD_1$),—, and so on. Thus, the outputs are simultaneously generated for the upper and lower electrodes regularly in the orders of red, blue, green, red,—, and so on for the upper electrodes and green, red, blue, green,—, and so on for the lower electrodes. The aforementioned data $UD_0$ to $UD_3$ and $LD_0$ to $LD_3$ outputted to the color liquid crystal display are outputted as the data shift clock signals of the liquid crystal driver by the shift clock SC delayed from the aforementioned latch signal $CL_3$ by the delay circuit 842.

The carry signal $CL_1$ of the aforementioned variable dot counter 803 is delayed by a delay circuit 810 composed of a D-type flip-flop circuit to output the latch signal LD as the data latch signal of one line to the liquid crystal driver.

When the vertical synchronizing signal Vsyc or the data for starting the drive of the 1st scanning line is inputted, to a NOR circuit 813 via inverter 833, the output of a NOR circuit 812 is set at "1". And, the latch signal LD from delay circuit 811 and inverter 809 of the aforementioned liquid crystal driver is delayed by a half period of the clock signal by the delay circuit 811 composed of a D-type flip-flop circuit and is inputted to the NOR circuit 812 to reset the output of the NOR circuit 812 at "0".

The output signal FRM of that NOR circuit 812 is outputted as the data (or the frame signal) for starting the common side scanning of the liquid crystal driver to the liquid crystal driver. On the other hand, the output FRM of the aforementioned NOR circuit 812 has its frequency divided by a flip-flop circuit 814 to output the AC drive control signal M for inverting the polarity to alternate the liquid crystal drive voltage for each time.

FIG. 9 shows a further embodiment of the present invention.

In FIG. 9, a latch pulse generator 903 is a circuit for generating one shot of latch pulse in response to each pulse from the output of an AND circuit 933. S/P converters 904, 905 and 906 are circuits for converting the red, green and blue video data into parallel signals. Memory circuits 907, 908 and 909 are circuits for storing the video data of the aformentioned S/P converters 904, 905 and 906. P/S converters 910, 911 and 912 are circuits for converting the read parallel data of the memories 907, 908 and 909 into serial data. AND circuits 934, 935 and 936 and an OR circuit 937 comprise a selecting gate circuit for retrieving the serial data orderly. An S/P converter 922 is a circuit for converting the serial data into parallel data to send the parallel data to the liquid crystal display. Switching circuits 913, 914 and 915 are circuits for opening and closing the bus lines of the parallel data of the aforementioned S/P converters 904, 905 and 906 to transfer them. Memory circuits 916, 917 and 918 store the video data to be fed to the lower half electrodes if the aforementioned memory circuits 907, 908 and 909 store the video data to be fed to the upper half electrodes of a multiplex matrix. P/S converters 919, 920 and 921 are circuits for likewise converting the parallel data read out from the memory circuits 916, 917 and 918 into serial data. AND circuits 938, 939 and 940 and an OR circuit 941 comprises a lower half selecting gate circuit. An S/P converter 923 is a circuit for transferring the parallel display data to the drivers of the lower half liquid crystal panel. A ring counter 929 is a circuit for sending selected pulses sequentially to the P/S converters 910 and 919, 911 and 920, and 912 and 921. A 1/9 counter 928 is a circuit for conducting 1/9 frequency division to generate a carry signal thereby to generate the read pulses of the data from the memories 907, 908, 909, 916, 917 and 918. A read address counter 927 is a circuit for counting the number of read addresses. A write address counter 925 is a circuit for counting the number of write addresses. A selector 926 is a circuit for selecting either the write or read address. A control circuit 924 is a circuit for controlling the write and read of the memories 907, 908, 909, 916, 917 and 918. A liquid crystal panel timing signal generator 931 is a circuit for generating a timing signal necessary for sending data to the liquid crystal driver to drive the liquid crystal.

The present embodiment is constructed of the circuits described above.

Next, the operations of FIG. 9 will be described in the following. The output of the AND circuit 933 connected to the Y-axis home position regulating circuit 901 and the X-axis home position regulating circuit 902 and made receptive of the clock signal CK is a clock signal L for transferring the video data in the effective display area. As a result, the latch pulse generator 903 counts the number of the video transferring clocks L. Moreover, the video signals DR, DG and DB are inputted to the shift registers of the S/P converters 904, 905 and 906, respectively, so that the aforementioned video transfer clocks are inputted as the shift clocks. When eight shots of the aforementioned video transfer clocks are inputted, latch pulses P are generated and fed to the memories 907, 908 and 909 or the memories 916, 917 and 918. These latch pulses P are inputted to the write address counter 925 via or gate 932 to increment the addresses and simultaneously to the selector 926 to switch the channel in a manner to select the write address so that the upper half memories 907, 908 and 909, or the lower half memories 916, 917 and 918 store the video data in response to the write signal $W_1$ or $W_2$ from the aforementioned control circuit 924.

The reading operations will be described in the following. The clock signal CK has its frequency divided by a frequency divider 930 and is inputted to the ring counter 929. Because of the construction of the ternary ring counter, the output of the ring counter 929 is selecting pulses for retrieving the red, green and blue data DR, DG and DB sequentially from the memories at the selecting gates in a time sharing manner. The output M having its frequency divided to $\frac{1}{3}$ by the ring counter 929 further has its frequency divided to 1/9 by the 1/9 counter 928. This 1/9 counter 928 outputs the carry signal each time the output of the aforementioned ring counter 929 is counted nine shots. This carry signal increments the address of the read address counter 927 and is simultaneously inputted to the control circuit 926 to output the read signal R. As a result, the data of the memories 907, 908 and 909 and the memories 916, 917 and 918 are transferred to the P/S converters 910, 911 and 912 and the P/S converters 919, 920 and 921 in response to the read signal R. Since the P/S converters 910, 911, 912, 919, 920 and 921 are constructed of latch circuits and 8-bit shift registers, each bit is extracted from the selecting gate circuits 934, 935, 936 and 937, and 938, 939, 940 and 941 in response to the shift clock of the ternary ring counter output of the aforementioned ring counter 929. As a result, the outputs of the OR circuits 937 and 941 are outputted in series as the mixed red, green and blue color data.

These serial output data are inputted to the S/P converters 922 and 923, respectively, so as to reduce the speed of transfer to the liquid crystal display driver so that they are converted into parallel signals and are outputted as the upper half display data $UD_0$ to $UD_3$ and the lower half display data $LD_0$ to $LD_3$.

The timing signals such as the data transfer clock to the liquid crystal panel driver, the frame signal or the data latch signal are the output of the frequency divider 930 by the liquid crystal panel timing generator 931. FIG. 10 is a circuit diagram showing one embodiment of the control circuit 924 according to the present invention.

The Y-axis home position regulating circuit 901 operates in the following manners. In response to the input of a vertical synchronizing signal Vsycn, the output $Q_1$ of a monostable multivibrator 1050 falls to "0" level with a predetermined delay time. As a result, the output of a NOR circuit 1051 rises to "1" level after the delay time through AND circuit 1052 so that an AND circuit 1053 outputs a horizontal synchronizing signal Hsycn.

A variable counter 1054 counts that horizontal synchronizing signal Hsycn. If the number of the scanning lines of the CRT interface is 400, the counted value is set at 200. As a result, while 200 shots or less of the horizontal synchronizing signals are counted, the output $Q_2$ of a flip-flop circuit 1057 is at the "1" level so that a NAND circuit 1058 outputs the write signal $W_1$ to the aforementioned memories 907, 908 and 909 to store the upper half video data. While the horizontal synchronizing signals Hsycn are counted 201 shots or more, the output $Q_3$ of the flip-flop circuit 1057 takes the "1" level, and the lower half video data are stored using wave shaper 1055 and flip-flop 1056 so that the write signal $W_2$ is outputted via gate 1059 to the memories 916, 917 and 918. The output $K_1$ of the variable counter 1054 resets the write address counter 925 for every 200 counts. As a result, when the memories 907, 908, 909, 916, 917 and 918 are read, the video data of the same address can be retrieved. Next, the operations of reading out the video data will be described in the following. The output $K_2$ of the 1/9 counter 928 outputs the carry signal for each 9th shot of the output M of the ternary ring counter 929. This output $K_2$ is fed through two-stage D-type flip-flops 1062 and 1061 so that outputs $Q_4$ and $Q_5$ are outputted by a NOR circuit 1060. Because of the control clock CK fed via inverters 914 and 1063, the output R of the NOR circuit 1060 can be operated as the read signal in a different timing as that of the aforementioned write signal $W_1$ or $W_2$. FIG. 11 shows a timing chart of the aforementioned control circuit.

FIG. 12 shows a video interface circuit which can be applied as a further embodiment to a liquid crystal display enabled to conduct the gradated color video display. In FIG. 12 reference Hsyc denotes a horizontal synchronizing signal, Vsyc denotes a vertical synchronizing signal, and RD, GD and BD denote respective signals of video display data in red, green and blue colors. CK denotes a clock signal.

A Y-axis display area control circuit 1202 is a control circuit for counting the number of the horizontal synchronizing signals Hsyc to determine the display area in the Y-axis direction. An X-axis display area control circuit 1204 is a control circuit for counting the number of the clock signals CK to determine the display area in the X-axis direction. A/D converter circuits 1206, 1207 and 1208 are converters for converting the analog voltages of the red, green and blue video signals into digital signals. Switch circuits 1209 to 1211 are circuits for switching the digital outputs of the aforementioned A/D converter circuits 1206 to 1208 to memory circuit RAMs 1212 to 1214. These RAMs 1212 to 1214 are memories for storing the outputs of the aforementioned switching circuits 1209 to 1211. An address counter 1224 is a circuit for counting up the addresses of the RAMs 1212 to 1214. Switch circuits 1215 to 1217 are switching circuits for transferring the stored data of the RAMs 1212 to 1214 to latch circuits 1218 to 1220. D/A converter circuits 1221 to 1223 are converters for converting the digital signals of the aforementioned latch circuits 1218 to 1220 into analog signals. An X-electrode driver circuit 1231 is a driver for driving the X-axis electrodes of a color liquid crystal panel 1230. A hold clock generator circuit 1226 is a circuit for generating the shift clocks of a shift register to shift the scanning data stored in a Y-electrode drive circuit 1229. A frame signal generator circuit 1227 is a circuit for causing the Y-electrode drive circuit 1229 to generate a signal to start the scan. An AC signal generator circuit is a circuit for generating a polarity switching signal for driving the liquid crystal panel with an AC current. The color liquid crystal display of the present invention is constructed of the circuits thus enumerated above.

Next, the operations of the circuit shown in FIG. 12 will be described. FIG. 13 is a timing chart of the circuit diagram in FIG. 12. In FIG. 12, the Y-axis display area control circuit 1202 is a circuit for setting the effective display period in the Y-axis direction and has built therein a counter for counting the vertical fly-back period and a counter for counting the number of the horizontal synchronizing signals for an effective display area period. The horizontal synchronizing signal Hsyc is inputted as a clock input to the Y-axis display area control circuit 1202. The output $T_1$ of the Y-axis display area control circuit 1202 becomes an output signal at an "H" level for the period (e.g., $400\times Hs$) of the effective display area in the Y-axis direction.

As a result, in response to the output $\phi_1$ of an AND circuit 1203, the horizontal synchronizing signal Hysc for the period of the effective display area in the Y-axis direction is inputted to the X-axis display area control circuit 1204. This X-axis display area control circuit 1204 is made to have the same construction as that of the aforementioned Y-axis display area control circuit and have therein a counter for counting the horizontal fly-back period, after the horizontal synchronizing signal Hsyc has been inputted, and a counter for counting the number of the dot clocks CK. These dot clocks CK are inputted as a clock input. The output $T_2$ of the X-axis display area control circuit 1204 is held at the "H" level for the period (e.g., $640\times Tck$) of the effective display area in the X-axis direction, as shown in FIG. 13. As a result, an AND circuit 1205 outputs a dot clock signal $\phi_2$ defining the effective display area. The analog voltages of the red, green and blue video signals RD, GD and BD have their peak voltage values converted into digital signals by the A/D converter circuits 1207 and 1208 respectively, and are inputted to the switch circuits 1209, 1210 and 1211.

The A/D converter circuits 1206 to 1208 are timed and held by the dot clocks $\phi_2$.

The display data of the switch circuits 1209 to 1211 are simultaneously written into the memory circuits 1212 to 1214 when the respective control signals $R/\overline{W}$ of the memory circuits 1212 to 1214 are at an "L" level. The addresses of the memory circuit RAMs 1212 to 1214 are accessed by the address counter 1224 which uses the dot clocks $\phi_1$ as its clock input and the vertical synchronizing signal Vsyc as its reset signal.

Next, the reading operation will be described in the following. When the control signal $R/\overline{W}$ of the memory circuit RAMs 1212 to 1214 is at the "H" level, the stored display data are read out from the RAMs 1212 to 1214 and are latched through the switch circuits 1215 to 1217 by the latch circuits 1218 to 1220. The latched outputs of these latch circuits 1218 to 1220 are inputted to the D/A converter circuits 1221 to 1223, respectively, to convert the digital values into analog voltages, which are outputted to the X-electrode drive circuit 1231.

The dot clock $\phi_2$ is delayed by a delay circuit 1225 and outputted, as a shift clock of the shift register built in the X-electrode drive circuit 1231, to the X-electrode drive circuit 1231. Moreover, a dot clock $\phi_3$ is inputted to the hold clock generator circuit 1226 via delay circuit 1225 to generate a hold signal $\phi_4$ effective to hold the data for one horizontal synchronizing signal period thereby to hold the analog voltages. The aforementioned hold signal $\phi_4$ is outputted, as a shift clock for a shift register built in the Y-electrode drive circuit 1229, to the Y-electrode drive circuit 1229. A frame signal $\phi_5$ of the frame signal generator circuit 1227 is outputted, as data for starting the scan of the Y-electrode drive circuit 1229, to the Y-electrode drive circuit 1229. The frame signal generator circuit 1227 is so constructed that it is synchronized by the vertical synchronizing signal Vsyc. Specifically, the frame signal generator circuit 1227 raises the frame signal $\phi_5$ to the "H" level in response to the vertical synchronizing signal Vsyc and resets the same at the "L" level after the first fall of the hold signal $\phi_4$. The AC signal generator circuit 1228 switches the drive voltages of the X-electrode drive circuit 1231 and the Y-electrode drive circuit 1229 with the output $\phi_6$ of the flip-flop circuit so that the polarity of the liquid crystal driving voltage can be inverted for each frame defined by the aforementioned frame signal $\phi_4$.

Next, a shift data generator circuit 1232 is a circuit for generating a pulse signal $\phi_7$ for generating data at the first stage of a shift register built in the X-electrode drive circuit 1231 and is made to have a construction similar to that of the aforementioned frame signal generator circuit 1227 so that it raises the pulse signal $\phi_7$ to the "H" level in response to the horizontal synchronizing signal Hsyc and then resets it at the "L" level after the first fall of the dot clock $\phi_2$. FIG. 14 is a diagram showing the X-electrode drive circuit to be used in the color liquid crystal display of the present invention. In FIG. 14, reference RA denotes the output signal of the aforementioned D/A converter circuit 1221 of the red video signal. Reference numeral 1440 denotes a normal operation amplifier, numeral 1441 denotes an inverse operation amplifier, numerals 1442 and 1443 denote transmission gate circuits constructed of analog switch circuits, numerals 1445 to 1447 denote shift register circuits, numeral 1464 denotes a level shift circuit, 1451 to 1453 denote analog switch circuits, numerals 1454 to 1456 denote hold circuits composed of capacitors, numerals 1458 to 1460 denote analog switch circuits, and numerals 1461 to 1463 denote hold circuits composed of capacitors. The X-electrode drive circuit is constructed of the circuits listed above. References $RX_1$ to $RX_3$ denote the output signals of the driver circuits which are fed to the X-axis electrodes colored with the red filters. The analog signals of the video signals are amplified by the operation amplifier circuits 1440 and 1441 with resistors $R_1$, $R_2$, $R_3$ and $R_4$ to generate a normally amplified signal $R_p$ and an inversely amplified signal $R_N$. The video signals of these amplified signals $R_P$ and $R_N$ are inputted to the transmission gate circuits 1442 and 1443 and are switched for each frame by the AC signal $\phi_6$ via gates 1464 and 1444. The output $R_S$ of the transmission gate circuits 1442 and 1443 is inputted to the switching circuits 1451 to 1453. The gate signals of the switching circuits 1451 to 1453 turn on the switching circuits 1451 to 1453 in response to each dot clock from the shift registers 1445 to 1447, which use the shift data $\phi_7$ as their data and the dot clocks $\phi_3$ as their shift clocks, to sequentially hold the analog voltages in the hold circuits 1454 to 1456 via gates 1448–1450. Next, when the hold clock $\phi_4$ is inputted to the gates of the switching circuits 1458 to 1460 via gate 1457, these circuits 1458 to 1460 are simultaneously turned on to hold the video signals in the hold circuits 1461 to 1463 thereby to drive the X-axis electrodes of the red filter of the liquid crystal panel with those analog signals. Since the Y-electrode drive circuit may be constructed of the sequential line scanning type of the prior art, the liquid crystal driver circuit according to the voltage averaging method can be used as it is. FIG. 15 shows an example of the drive wave forms of the present invention. The drive wave forms are applied between $RX_1$–$Y_1$ of the liquid crystal such that the drive voltages according to the video signals are applied in an alternating manner by an X-axis drive voltage $RX_1$ and a Y-axis drive voltage $Y_1$.

As has been described hereinbefore, according to the embodiment, the color video signals are converted into the digital signals and stored in the memory circuits and are then converted into the analog signals for video display. As a result, the video signals can be easily displayed selectively in the form of a moving or still picture. Another outstanding effect is that the large-sized liquid crystal display or the like having been used in nothing but an OA device such as a personal computer or word processor of monochromatic and ON/OFF display can be widely used in place of the video display terminal device such as a computer graphic display or a wall TV set.

What is claimed is:

1. A circuit for interfacing a video signal for a scanning color display to a matrix color display, comprising: three memory means controllable to store data and each receptive of one of three different color video signals for a scanning color display having pulse trains of serial color data separated by blanking periods; timing means for producing a timing signal corresponding to the blanking period for each video signal; control means receptive of the timing signal for controlling each of the memory means to prevent the storage of data during the blanking periods; means for temporarily receiving data from each of the three memory means to store the data as parallel data words; means for producing mixed color display data from the parallel data words comprising switching means for sequentially selecting data bits in a least significant bit order from each word in turn and producing an uninterrupted serial train of data bits alternately corresponding to three colors, the switching means including six switch circuits each having four output terminals; and applying means for applying the serial train of data bits to a matrix color display, the applying means including four input terminals each connected with a respective one of each of said output terminals of each respective one of said switch circuits.

2. The circuit according to claim 1; further comprising means for generating clock pulses; and wherein the video signals include a synchronizing signal; the timing means comprises means for counting clock pulses after the synchronizing signal to produce a start timing signal corresponding to the end of each blanking period; and the control means includes means receptive of the start timing signal to effect storage by the memory means after the end of the blanking period.

3. The circuit according to claim 1; wherein the means for temporarily receiving data comprises three registers for storing the color data for three different colors.

4. The circuit according to claim 3; wherein the switching means includes a ring counter for sequentially enabling the switch circuits to obtain data from the registers in a time sharing manner.

5. A circuit for interfacing a video signal for a scanning color display to a matrix color display, comprising: three memory means controllable to store data and each receptive of one of three different color video signals for a scanning color display having pulse trains of serial color data separated by blanking periods; timing means for producing a timing signal corresponding to the blanking period for each video signal; control means receptive of the timing signal for controlling each of the memory means to prevent the storage of data during the blanking periods; means for temporarily receiving data from each of the three memory means to store the data as parallel data words; means for producing mixed color display data from the parallel data words comprising switching means for sequentially selecting data bits in a least significant bit order from each word in turn and producing an uninterrupted serial train of data bits alternately corresponding to three colors, the switching means including at least two switch circuits each having a plurality of output terminals; and applying means for applying the serial train of data bits to a matrix color display, the applying means including a plurality of input terminals each connected with a respective one of said plurality of output terminals of each respective one of said switch circuits.

6. The circuit according to claim 5; further comprising means for generating clock pulses; and wherein the video signals include a synchronizing signal; the timing means comprises means for counting clock pulses after the synchronizing signal to produce a start timing signal corresponding to the end of each blanking period; and the control means includes means receptive of the start timing signal to effect storage by the memory means after the end of the blanking period.

7. The circuit according to claim 5; wherein the means for temporarily receiving data comprises three registers for storing the color data for three different colors.

8. The circuit according to claim 7; wherein the switching means comprises switch circuits connected to the registers; and a ring counter for sequentially enabling the switch circuits to obtain data from the registers in a time sharing manner.

* * * * *